US010356518B2

(12) United States Patent
Kiyoshige

(10) Patent No.: US 10,356,518 B2
(45) Date of Patent: Jul. 16, 2019

(54) FIRST RECORDING DEVICE, SECOND RECORDING DEVICE, RECORDING SYSTEM, FIRST RECORDING METHOD, SECOND RECORDING METHOD, FIRST COMPUTER PROGRAM PRODUCT, AND SECOND COMPUTER PROGRAM PRODUCT

(71) Applicant: OLYMPUS CORPORATION, Tokyo (JP)

(72) Inventor: Ryuichi Kiyoshige, Tokyo (JP)

(73) Assignee: OLYMPUS CORPORATION, Tokyo (JP)

( * ) Notice: Subject to any disclaimer, the term of this patent is extended or adjusted under 35 U.S.C. 154(b) by 180 days.

(21) Appl. No.: 15/489,012

(22) Filed: Apr. 17, 2017

(65) Prior Publication Data

US 2017/0223453 A1 Aug. 3, 2017

Related U.S. Application Data

(63) Continuation of application No. PCT/JP2015/075855, filed on Sep. 11, 2015.

(30) Foreign Application Priority Data

Oct. 21, 2014 (JP) ..... 2014-214421

(51) Int. Cl.
*H04R 3/00* (2006.01)
*G10L 21/0232* (2013.01)
(Continued)

(52) U.S. Cl.
CPC ..... *H04R 3/005* (2013.01); *G10L 21/0232* (2013.01); *G10L 25/60* (2013.01);
(Continued)

(58) Field of Classification Search
CPC combination set(s) only.
See application file for complete search history.

(56) References Cited

U.S. PATENT DOCUMENTS

2004/0044525 A1* 3/2004 Vinton ..... H03G 5/165 704/224
2004/0078199 A1* 4/2004 Kremer ..... G10L 21/0208 704/233
2007/0021958 A1* 1/2007 Visser ..... G10L 21/0272 704/226

FOREIGN PATENT DOCUMENTS

JP H06-110455 A 4/1994
JP 2002-258895 A 9/2002
(Continued)

OTHER PUBLICATIONS

Notice of Allowance dated Aug. 7, 2018, issued in counterpart Japanese application No. 2014-214421, wtih English translation. (6 pages).
(Continued)

*Primary Examiner* — Duc Nguyen
*Assistant Examiner* — Assad Mohammed
(74) *Attorney, Agent, or Firm* — Westerman, Hattori, Daniels & Adrian, LLP

(57) ABSTRACT

A technology is provided that can obtain two audio data with reduced noise, in a system including independent recording devices. A first frequency analyzer performs first frequency analysis on first audio data for each analysis range and generates first result information indicating the result of the first frequency analysis for each analysis range. A condition determinator determines the analysis range based on a first audio quality of the first audio data. A noise band detector detects a noise band for each analysis range based on the first result information and second result information. A first filter processor generates a first filter for filtering data of a
(Continued)

noise band for each analysis range, applies a first filter process by the first filter on first audio data for each analysis range, and generates third audio data.

10 Claims, 15 Drawing Sheets

(51) Int. Cl.

| | |
|---|---|
| ***G10L 25/60*** | (2013.01) |
| ***H04R 1/40*** | (2006.01) |
| ***H04R 3/04*** | (2006.01) |
| *G10L 21/0216* | (2013.01) |

(52) U.S. Cl.
CPC ..... *H04R 1/406* (2013.01); *H04R 3/04* (2013.01); *G10L 2021/02166* (2013.01); *H04R 2420/07* (2013.01); *H04R 2430/03* (2013.01)

(56) References Cited

FOREIGN PATENT DOCUMENTS

| | | | |
|---|---|---|---|
| JP | 2013-78118 | A | 4/2013 |
| JP | 2014-92705 | A | 5/2014 |
| JP | 2014-174393 | A | 9/2014 |

OTHER PUBLICATIONS

International Search Report dated Dec. 15, 2015, issued in counterpart International Application No. PCT/JP2015/075855 (1 page).

* cited by examiner

FIRST RECORDING DEVICE, SECOND RECORDING DEVICE, RECORDING SYSTEM, FIRST RECORDING METHOD, SECOND RECORDING METHOD, FIRST COMPUTER PROGRAM PRODUCT, AND SECOND COMPUTER PROGRAM PRODUCT

CROSS REFERENCE TO RELATED APPLICATIONS

This application is a continuation application based on a PCT Patent Application No. PCT/JP2015/075855, filed on Sep. 11, 2015, whose priority is claimed on Japanese Patent Application No. 2014-214421, filed on Oct. 21, 2014. The content of both the PCT Application and the Japanese Application are incorporated herein by reference.

BACKGROUND OF THE INVENTION

Field of the Invention

This invention relates to a recording technology using a plurality of recording devices.

Description of the Related Art

Recording using an IC recorder may be performed at a small-scale concert such as a recital of a music class. Such recording is performed in a state where the microphone of the IC recorder disposed at auditorium seats is directed toward the performer on the stage. At this time, a zoom function having directionality is used such that only the performer's performance is clearly recorded.

However, it is difficult to obtain perfect directivity with the microphone built in the IC recorder. For example, noise such as sound that an audience makes when opening a brochure or sound of cough may be mixed in the desired audio. Therefore, it is difficult to obtain a good recording result.

The principle of a general directional microphone will be described. The directional microphone is configured with a plurality of microphones. The plurality of microphones are arranged to be directed toward the direction of an audio source that generates audio to be recorded and its opposite direction, respectively. Audio other than audio from the sound source is canceled, by inverting the phase of audio from the direction opposite to the sound source direction, and superimposing the audio on audio from the direction of the sound source.

In order to further improve the directivity of the microphone, advanced design considering the propagation characteristics of sound waves and the like is required. It is difficult to obtain high performance unless each microphone is disposed in an appropriate position. Therefore, the degree of freedom in design such as the size and shape of a device and the arrangement of respective microphones is limited. Due to these conditions, the cost of design and manufacturing to obtain high directivity is high. Therefore, in general, a directional microphone function with high performance is mounted in a professional IC recorder used for a specific application. On the other hand, a general-purpose IC recorder used by users other than professional users is equipped with a directional microphone function called a zoom microphone. However, in order to maintain the balance between cost, versatility, convenience of carrying and the like, a microphone which obtains high directivity is not mounted.

Japanese Unexamined Patent Application Publication No. 2013-78118 discloses a method of reducing a noise component included in an audio signal. In the method disclosed in Japanese Unexamined Patent Application Publication No. 2013-78118, a main audio microphone and a reference microphone that collects noise are determined by using a phase difference between audio signals obtained by a plurality of microphones provided in a device.

SUMMARY OF THE INVENTION

According to a first aspect of the present, a first recording device includes: a first audio input part configured to receive first audio, and generate first audio data from the received first audio; a first communicator; a first frequency analyzer configured to perform first frequency analysis on the first audio data for each of a plurality of analysis ranges, and generate first result information indicating a result of the first frequency analysis for each of the plurality of analysis ranges; a condition determinator configured to determine a first start position and a second start position, determine the analysis range in accordance with a first audio quality of the first audio data, the first start position being a position of the first audio data at which the first frequency analysis is started, the second start position being a position of second audio data at which second frequency analysis is started; a noise band detector configured to detect a noise band for each of the plurality of analysis ranges based on the first result information and second result information; a first filter processor configured to generate a first filter for filtering data of the noise band for each of the plurality of analysis ranges, apply a first filter process by the first filter on the first audio data for each of the plurality of analysis ranges, and thereby generate third audio data; and a first recorder configured to record the third audio data. The first communicator transmits information on the second start position and the analysis range, to a second recording device, the first communicator further receives the second result information from the second recording device for each of the plurality of analysis ranges, the first communicator further transmits information on the noise band to the second recording device for each of the plurality of analysis ranges, and the second recording device generates the second audio data from second audio, performs the second frequency analysis on the second audio data for each of the plurality of analysis ranges, generates the second result information indicating a result of the second frequency analysis for each of the plurality of analysis ranges, generates a second filter for filtering data of the noise band for each of the plurality of analysis ranges, applies a second filter process by the second filter on the second audio data for each of the plurality of analysis ranges, and thereby generates fourth audio data for each of the plurality of analysis ranges.

According to a second aspect of the present invention, the first recording device according to the first aspect may further include: a first audio quality determinator configured to determine a second audio quality of the second audio data based on the first audio quality, the second audio quality being different from the first audio quality. The first communicator may further transmit audio quality information about the second audio quality, to the second recording device.

According to a third aspect of the present invention, the first recording device according to the first aspect may further include: a time difference calculator configured to detect a phase difference between the first audio and the second audio through a comparison process for comparing the first audio data and the second audio data, and calculate a difference between system times of the first recording device and the second recording device based on the detected phase difference. The condition determinator may determine the first start position and the second start position based on the difference between system times, and the first communicator may further receive the second audio data from second recording device.

According to a fourth aspect of the present invention, a second recording device includes: a second audio input part configured to receive second audio, and generate second audio data from the received second audio; a second communicator; a second frequency analyzer configured to perform second frequency analysis on the second audio data for each of a plurality of analysis ranges, and generate second result information indicating a result of the second frequency analysis for each of the plurality of analysis ranges; a second filter processor configured to generate a second filter for filtering data of a noise band for each of the plurality of analysis ranges, apply a second filter process by the second filter on the second audio data for each of the plurality of analysis ranges, and thereby generate fourth audio data for each of the plurality of analysis ranges; and a second recorder that records the fourth audio data. The second communicator further receives information on the second start position and the analysis range from a first recording device, the second communicator further transmits the second result information to the first recording device for each of the plurality of analysis ranges, the second communicator further receives information on the noise band from the first recording device for each of the plurality of analysis ranges, the first recording device generates first audio data from first audio, performs first frequency analysis on the first audio data for each of the plurality of analysis ranges, generates first result information indicating a result of the first frequency analysis for each of the plurality of analysis ranges, determines a first start position and the second start position, determines the analysis range in accordance with a first audio quality of the first audio data, detects the noise band for each of the plurality of analysis ranges based on the first result information and the second result information, generates a first filter for filtering data of the noise band for each of the plurality of analysis ranges, applies a first filter process by the first filter on the first audio data for each of the plurality of analysis ranges, and thereby generates third audio data for each of the plurality of analysis ranges, and the first start position is a position of the first audio data at which the first frequency analysis is started, and the second start position is a position of the second audio data at which the second frequency analysis is started.

According to a fifth aspect of the present invention, the second recording device according to the fourth aspect may further include: a second audio quality determinator configured to determine a second audio quality of the second audio data based on audio quality information. The second communicator may further receive the audio quality information from the first recording device.

According to a sixth aspect of the present invention, a recording system includes: a first recording device; and a second recording device. The first recording device includes: a first audio input part configured to receive first audio, and generate first audio data from the received first audio; a first communicator; a first frequency analyzer configured to perform first frequency analysis on the first audio data for each of a plurality of analysis ranges, and generate first result information indicating a result of the first frequency analysis for each of the plurality of analysis ranges; a condition determinator configured to determine a first start position and a second start position, determine the analysis range in accordance with a first audio quality of the first audio data, the first start position being a position of the first audio data at which the first frequency analysis is started, the second start position being a position of second audio data at which second frequency analysis is started; a noise band detector configured to detect a noise band for each of the plurality of analysis ranges based on the first result information and second result information; a first filter processor configured to generate a first filter for filtering data of the noise band for each of the plurality of analysis ranges, apply a first filter process by the first filter on the first audio data for each of the plurality of analysis ranges, and thereby generate third audio data by; and a first recorder configured to record the third audio data. The first communicator transmits information on the second start position and the analysis range, to the second recording device, the first communicator further receives the second result information from the second recording device for each of the plurality of analysis ranges, and the first communicator further transmits information on the noise band to the second recording device for each of the plurality of analysis ranges. The second recording device includes: a second audio input part configured to receive second audio, and generate the second audio data from the received second audio; a second communicator; a second frequency analyzer configured to perform the second frequency analysis on the second audio data for each of a plurality of analysis ranges, and generate second result information indicating a result of the second frequency analysis for each of the plurality of analysis ranges; a second filter processor configured to generate a second filter for filtering data of the noise band for each of the plurality of analysis ranges, apply a second filter process by the second filter on the second audio data for each of the plurality of analysis ranges, and thereby generate fourth audio data for each of the plurality of analysis ranges; and a second recorder configured to record the fourth audio data. The second communicator receives information on the second start position and the analysis range from the first recording device, the second communicator further transmits the second result information to the first recording device for each of the plurality of analysis ranges, and the second communicator further receives information on the noise band from the first recording device for each of the plurality of analysis ranges.

According to a seventh aspect of the present invention, a first recording method performed by a first recording device, includes: a first audio input step of receiving first audio, and generating first audio data from the received first audio; a first frequency analysis step of performing first frequency analysis on the first audio data for each of a plurality of analysis ranges, and generating first result information indicating a result of the first frequency analysis for each of the plurality of analysis ranges; a condition determination step of determining a first start position and a second start position, determining the analysis range in accordance with a first audio quality of the first audio data, the first start position being a position of the first audio data at which the first frequency analysis is started, and the second start position being a position of second audio data at which second frequency analysis is started; a noise band detection step of detecting a noise band for each of the plurality of analysis ranges based on the first result information and second result information; a first filter processing step of generating a first filter for filtering data of the noise band for each of the plurality of analysis ranges, applying a first filter process by the first filter on the first audio data for each of the plurality of analysis ranges, and thereby generating third audio data; a first recording step of recording the third audio data; a first transmission step of transmitting information on the second start position and the analysis range, to a second recording device; a reception step of receiving the second result information from the second recording device for each of the plurality of analysis ranges; and a second transmission step of transmitting information on the noise band to the second recording device for each of the plurality of analysis ranges. The second recording device generates the second audio data from second audio, performs the second frequency analysis on the second audio data for each of the plurality of analysis ranges, generates the second result information indicating a result of the second frequency analysis for each of the plurality of analysis ranges, generates a second filter for filtering data of the noise band for each of the plurality of analysis ranges, applies a second filter process by the second filter on the second audio data for each of the plurality of analysis ranges, and thereby generates fourth audio data for each of the plurality of analysis ranges.

According to an eighth aspect of the present invention, a second recording method performed by a second recording device, includes: a second audio input step of receiving second audio, and generating second audio data from the received second audio; a second frequency analysis step of performing second frequency analysis on the second audio data for each of a plurality of analysis ranges, and generating second result information indicating a result of the second frequency analysis for each of the plurality of analysis ranges; a second filter processing step of generating a second filter for filtering data of the noise band for each of the plurality of analysis ranges, applies a second filter process by the second filter on the second audio data for each of the plurality of analysis ranges, and thereby generates fourth audio data; a second recording step of recording the fourth audio data; a first reception step of receiving information on the second start position and the analysis range from the first recording device; a transmission step of transmitting the second result information to the first recording device for each of the plurality of analysis ranges; and a second reception step of receiving information on the noise band from the first recording device for each of the plurality of analysis ranges. The first recording device generates first audio data from first audio, performs first frequency analysis on the first audio data for each of the plurality of analysis ranges, generates first result information indicating a result of the first frequency analysis for each of the plurality of analysis ranges, determines a first start position and the second start position, determines the analysis range in accordance with a first audio quality of the first audio data, detects the noise band for each of the plurality of analysis ranges based on the first result information and the second result information, generates a first filter for filtering data of the noise band for each of the plurality of analysis ranges, applies a first filter process by the first filter on the first audio data for each of the plurality of analysis ranges, and thereby generates third audio data for each of the plurality of analysis ranges, and the first start position is a position of the first audio data at which the first frequency analysis is started, and the second start position is a position of the second audio data at which the second frequency analysis is started.

According to a ninth aspect of the present invention, a first computer program product comprising computer readable instructions, which when loaded and run in a computer processor of a first recording device, causes the processor to execute: a first audio input step of receiving first audio, and generating first audio data from the received first audio; a first frequency analysis step of performing first frequency analysis on the first audio data for each of a plurality of analysis ranges, and generating first result information indicating a result of the first frequency analysis for each of the plurality of analysis ranges; a condition determination step of determining a first start position and a second start position, determining the analysis range in accordance with a first audio quality of the first audio data, the first start position being a position of the first audio data at which the first frequency analysis is started, and the second start position being a position of second audio data at which second frequency analysis is started; a noise band detection step of detecting a noise band for each of the plurality of analysis ranges based on the first result information and second result information; a first filter processing step of generating a first filter for filtering data of the noise band for each of the plurality of analysis ranges, applying a first filter process by the first filter on the first audio data for each of the plurality of analysis ranges, and thereby generating third audio data; a first recording step of recording the third audio data; a first transmission step of transmitting information on the second start position and the analysis range, to a second recording device; a reception step of receiving the second result information from the second recording device for each of the plurality of analysis ranges; and a second transmission step of transmitting information on the noise band to the second recording device for each of the plurality of analysis ranges. The second recording device generates the second audio data from second audio, performs the second frequency analysis on the second audio data for each of the plurality of analysis ranges, generates the second result information indicating a result of the second frequency analysis for each of the plurality of analysis ranges, generates a second filter for filtering data of the noise band for each of the plurality of analysis ranges, applies a second filter process by the second filter on the second audio data for each of the plurality of analysis ranges, and thereby generates fourth audio data for each of the plurality of analysis ranges.

According to a tenth aspect of the present invention, a second computer program product comprising computer readable instructions, which when loaded and run in a computer processor of a second recording device, causes the processor to execute: a second audio input step of receiving second audio, and generating second audio data from the received second audio; a second frequency analysis step of performing second frequency analysis on the second audio data for each of a plurality of analysis ranges, and generating second result information indicating a result of the second frequency analysis for each of the plurality of analysis ranges; a second filter processing step of generating a second filter for filtering data of the noise band for each of the plurality of analysis ranges, applies a second filter process by the second filter on the second audio data for each of the plurality of analysis ranges, and thereby generates fourth audio data; a second recording step of recording the fourth audio data; a first reception step of receiving information on the second start position and the analysis range from the first recording device; a transmission step of transmitting the second result information to the first recording device for each of the plurality of analysis ranges; and a second reception step of receiving information on the noise band from the first recording device for each of the plurality of analysis ranges. The first recording device generates first audio data from first audio, performs first frequency analysis on the first audio data for each of the plurality of analysis ranges, generates first result information indicating a result of the first frequency analysis for each of the plurality of analysis ranges, determines a first start position and the second start position, determines the analysis range in accordance with a first audio quality of the first audio data, detects the noise band for each of the plurality of analysis ranges based on the first result information and the second result information, generates a first filter for filtering data of the noise band for each of the plurality of analysis ranges, applies a first filter process by the first filter on the first audio data for each of the plurality of analysis ranges, and thereby generates third audio data for each of the plurality of analysis ranges, and the first start position is a position of the first audio data at which the first frequency analysis is started, and the second start position is a position of the second audio data at which the second frequency analysis is started.

DETAILED DESCRIPTION OF THE PREFERRED EMBODIMENTS (System Configuration)

Figure 1:
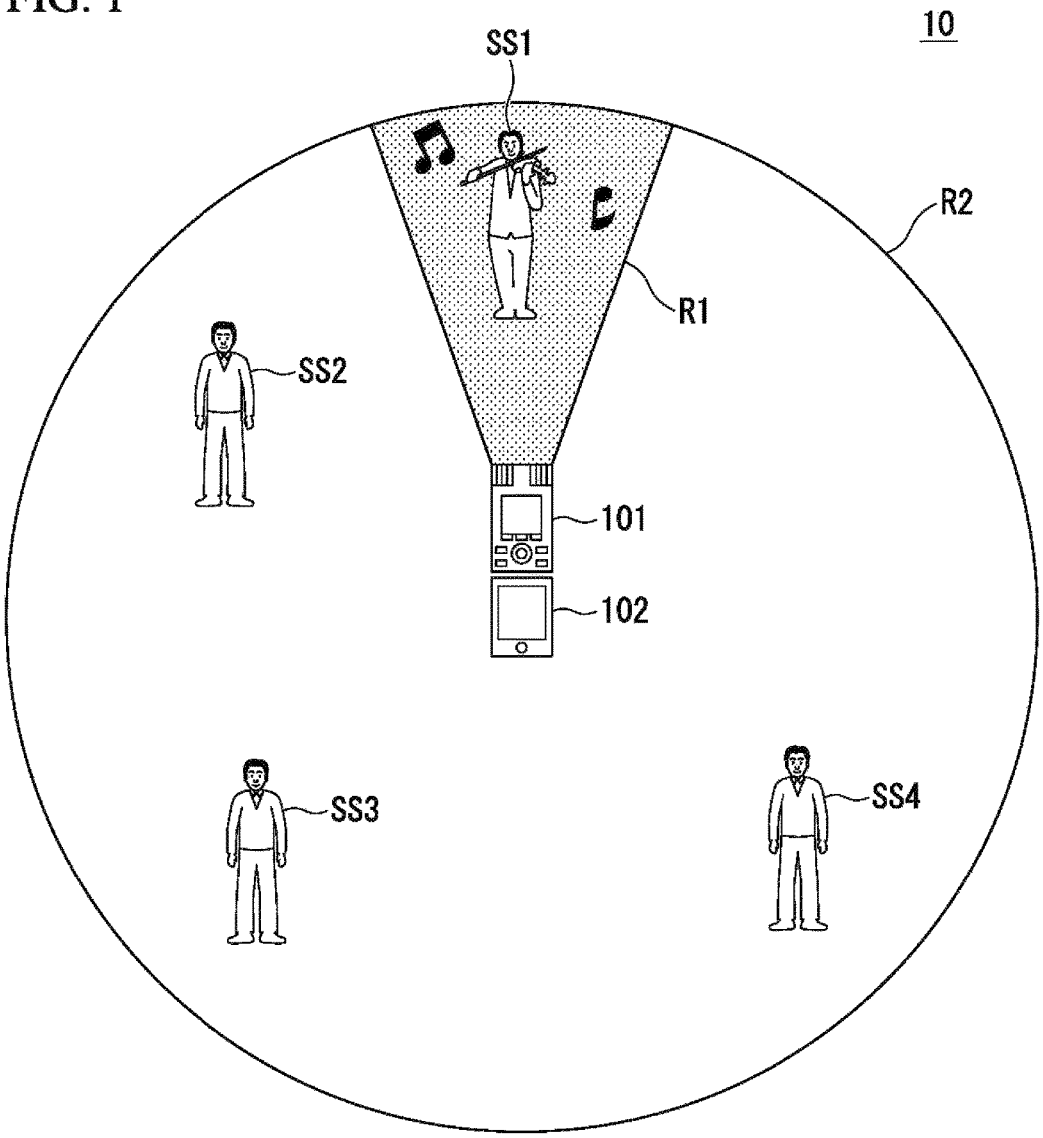
FIG. 1 is a schematic diagram illustrating a configuration of a recording system according to an embodiment of the present invention.

Hereinafter, embodiments of the present invention will be described with reference to the drawings. FIG. 1 illustrates a configuration of a recording system 10 according to an embodiment of the present invention. As illustrated in FIG. 1, a recording system 10 includes a first recording device 101 and a second recording device 102. The first recording device 101 and the second recording device 102 record various audio such as the speaker's voice in a conference, a lecture meeting or the like, the music which a performer plays in a music event or an instrument performance, and the like. In addition, the first recording device 101 and the second recording device 102 perform data communication with other communication terminals.

There are a first sound source SS1 and second sound sources SS2, SS3, and SS4, in the surroundings of the first recording device 101 and the second recording device 102. The first sound source SS1 generates the audio to be recorded. The second sound sources SS2, SS3, and SS4 generate noise other than the audio to be recorded.

The first recording device 101 directs the microphone in the direction of the first sound source SS1. In addition, the first recording device 101 has a directional function capable of mainly collecting audio from the direction of a sound source (target sound source) that generates audio to be recorded. The first recording device 101 can switch the directivity/non-directivity of the microphone. The performance of the first recording device 101 is not specialized in microphone performance that can obtain high directivity. That is, even in a case where the directional function of the first recording device 101 is effective, the first recording device 101 cannot completely block audio from sound sources other than the target sound source. The directional function of the first recording device 101 can collect audio from the first sound source SS1, which is a target sound source mainly existing in the range R1. Further, the directional function of the first recording device 101 collects audio from the second sound sources SS2, SS3, and SS4, which are not the target sound source. The volume of audio from the second sound sources SS2, SS3, SS4 is smaller than the volume of audio from the target sound source.

The second recording device 102 is located in the vicinity of the first recording device 101. It is desirable that a distance between the first recording device 101 and the second recording device 102 be within 1 m. The second recording device 102 includes an omnidirectional microphone. Therefore, the second recording device 102 collects audio from the first sound source SS1 and the second sound sources SS2, SS3, and SS4 which are placed in the range R2, without distinction.

The first recording device 101 and the second recording device 102 are in a state where they can communicate with each other. The first recording device 101 and the second recording device 102 notify the communication partner of the result obtained by performing an audio signal analysis on the respectively collected audio. Thus, the first recording device 101 and the second recording device 102 discriminate between audio from the target sound source and audio from the other sound sources in cooperation with each other, and obtain good audio data with suppressed noise. A detailed method for obtaining good audio data will be described below.

In the embodiment of the present invention, the first recording device 101 and the second recording device 102 obtain two audio data of different audio qualities. For example, the first recording device 101 obtains audio data in which high quality audio is recorded, and the second recording device 102 obtains audio data in which low quality audio is recorded. For example, the audio data obtained by the second recording device 102 can be used for posting on a Web site on the Internet.

(Configuration of First Recording Device 101)

Figure 2:
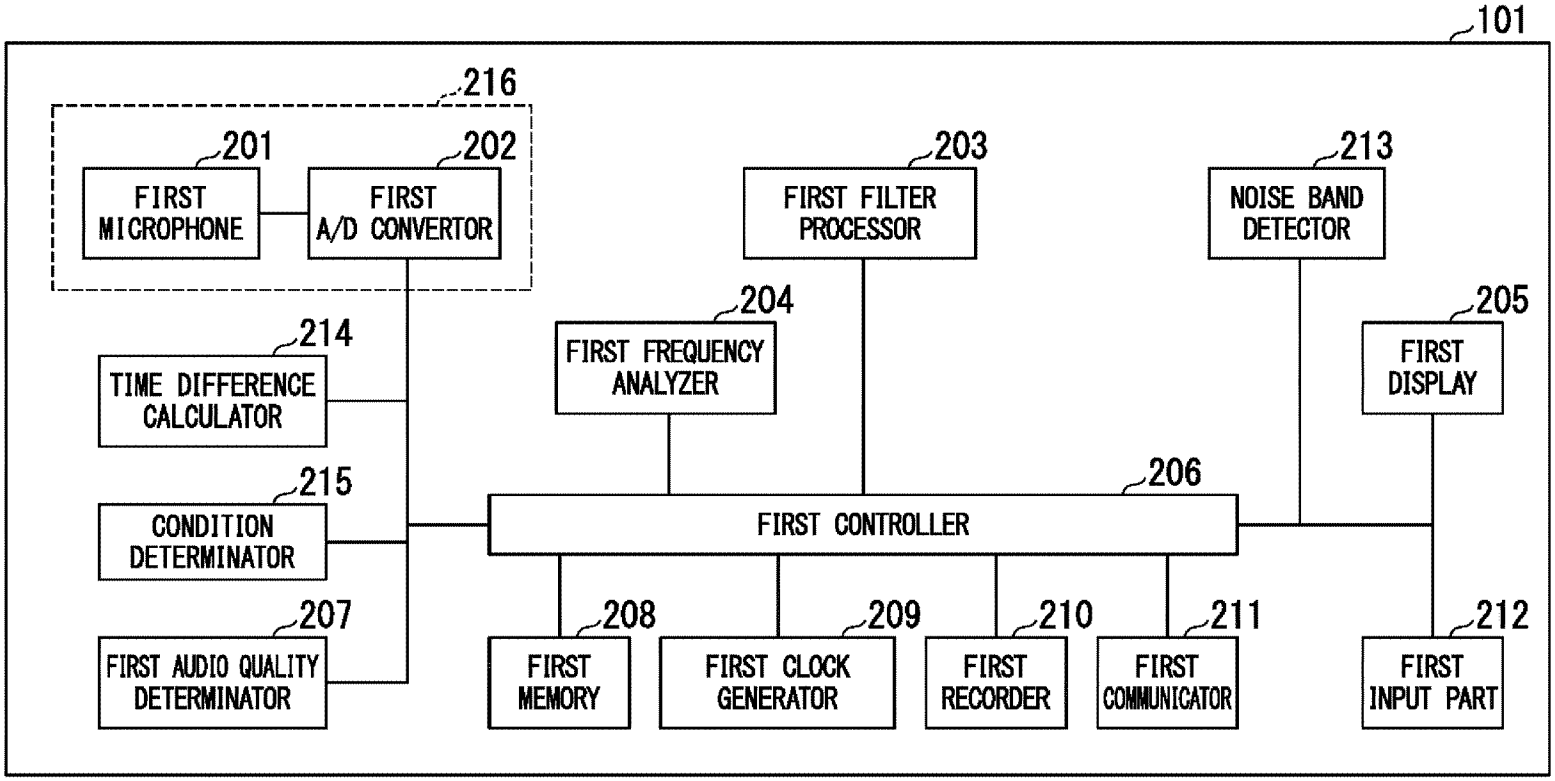
FIG. 2 is a block diagram illustrating a configuration of a first recording device according to the embodiment of the present invention.

FIG. 2 illustrates a configuration of the first recording device 101. As illustrated in FIG. 2, the first recording device 101 includes a first microphone 201, a first A/D converter 202, a first filter processor 203, a first frequency analyzer 204, a first display 205, a first controller 206, a first audio quality determinator 207, a first memory 208, a first clock generator 209, a first recorder 210, a first communicator 211, a first input part 212, a noise band detector 213, a time difference calculator 214, and a condition determinator 215.

The first microphone 201 includes a microphone array configured with a plurality of condenser microphones to realize directional/omnidirectional function. The roles of a main microphone or a sub microphone are determined for each condenser microphone in the microphone array. Respective condenser microphones are arranged to collect audio in mutually different directions. Each condenser microphone converts each collected audio into an analog signal. The first microphone 201 obtains a first analog signal with a reduced influence from audio other than the audio from a specific direction by inverting the phase of the analog signal obtained by the sub microphone and superimposing the analog signal on the analog signal obtained by the main microphone. In the following description, the directional function of the first microphone 201 is effective. As described above, the first microphone 201 cannot completely block audio from sound sources other than the first sound source SS1.

The first A/D converter 202 converts the first analog signal obtained by the first microphone 201 into digital data, that is, first audio data based on the sampling frequency and the number of quantization bits. The sampling frequency, which is one of the sampling conditions, is a previously prepared parameter value such as 48 kHz/96 kHz/192 kHz. The number of quantization bits, which is one of the sampling conditions, is a previously prepared parameter value such as 16 bits/32 bits.

The first microphone 201 and the first A/D converter 202 constitute the first audio input part 216. First audio is input to the first audio input part 216. The first audio input part 216 generates first audio data from the received first audio.

The time difference calculator 214 detects a phase difference between the first audio and the second audio, with a comparison process for comparing the first audio data and the second audio data. The second audio data is generated from the second audio by the second recording device 102. The time difference calculator 214 calculates a difference between system times (time difference) of the first recording device 101 and the second recording device 102 based on the detected phase difference.

The first frequency analyzer 204 performs first frequency analysis on the first audio data for each of a plurality of analysis ranges and generates first result information indicating the result of first frequency analysis for each of the plurality of analysis ranges. Specifically, the first frequency analyzer 204 analyzes the frequency characteristics of audio included in the first audio data by performing Fourier transform on the first audio data. The first frequency analyzer 204 obtains the frequency information of audio included in first audio data, and first result information including amplitude information and phase information for each frequency. The analysis range is the range of the first audio data obtained in a predetermined period. The first frequency analyzer 204 performs first frequency analysis on first audio data of each of the plurality of analysis ranges.

The condition determinator 215 determines a first start position and a second start position. For example, the condition determinator 215 determines a first start position and a second start position based on the difference between system times of the first recording device 101 and the second recording device 102. Further, the condition determinator 215 determines an analysis range in accordance with a first audio quality of the first audio data. The first start position is the position of the first audio data at which the first frequency analysis is started. The second start position is the position of the second audio data at which the second frequency analysis is started. A second frequency analysis is performed on the second audio data by the second recording device 102. The second frequency analysis is the same process as the first frequency analysis. The first audio quality considered when the analysis range is determined is the condition when the first audio input part 216 generates the first audio data, that is, the sampling frequency when the first A/D converter 202 converts the analog signal to digital data.

The noise band detector 213 detects a noise band for each of the plurality of analysis ranges based on the first result information and the second result information. The first result information indicates the result of the first frequency analysis. The second result information indicates the result of the second frequency analysis. Specifically, the noise band detector 213 estimates a portion corresponding to audio from sound sources other than the target sound source included in the first audio data and the second audio data based on the first result information and the second result information. The noise band detector 213 generates noise band information including frequency information representing the estimated portion and amplitude information and phase information for each frequency.

The first filter processor 203 generates a first filter for filtering the data of the noise band for each of the plurality of analysis ranges. The first filter processor 203 applies a first filter process by the first filter on the first audio data for each of the plurality of analysis ranges. Thus, the first filter processor 203 generates third audio data for each of the plurality of analysis ranges. That is, the first filter processor 203 generates third audio data from the first audio data for each of the plurality of analysis ranges.

The first audio quality determinator 207 determines the second audio quality of the second audio data based on the first audio quality of the first audio data. The second audio quality is different from the first audio quality. When an analog signal is converted into digital data, the quality of the digital data changes, depending on the values of the sampling frequency and the number of quantization bits. That is, the first audio quality and the second audio quality are the sampling condition including the sampling frequency and the number of quantization bits. The second audio quality may be lower than the first audio quality.

The first memory 208 temporarily stores information such as time difference information for managing the operation state of the inside the system during the execution of recording, and the first audio data generated by the first A/D converter 202. The first clock generator 209 generates a system clock that counts the reference time, that is, the system time used inside the first recording device 101. The first recorder 210 records the third audio data generated by the first filter processor 203. The first recorder 210 has a recording medium on which the third audio data is recorded. Alternatively, the recording medium on which the third audio data is recorded is connected to the first recorder 210.

The first communicator 211 and the second recording device 102, which is another recording device, constitute a wired network or a wireless network. For example, the wired network is a Universal Serial Bus (USB) or Ethernet (registered trademark). For example, the wireless network is a wireless Local Area Network (LAN). The first communicator 211 communicates second audio data, various types of information, a request message, its response message, or the like. Specifically, the first communicator 211 receives the second audio data generated from the second audio from the second recording device 102. The first communicator 211 further transmits audio quality information on the second audio quality to the second recording device 102. The first communicator 211 further transmits information on the second start position and the analysis range to the second recording device 102. The first communicator 211 further receives second result information from the second recording device 102 for each of the plurality of analysis ranges. The first communicator 211 further transmits information on the noise band to the second recording device 102 for each of the plurality of analysis ranges.

The first display 205 displays a list of first audio quality information that can be set in the first recording device 101. The first input part 212 is a user interface that accepts an input from the user. The first input part 212 accepts the selection of the first audio quality information from the user, after the list of first audio qualities is displayed on the first display 205.

The first controller 206 controls each part of the first recording device 101. For example, the first controller 206 reads a program including an instruction that defines the operation of the first controller 206, and executes the read program. This program may be provided by a "computer-readable recording medium" such as a flash memory. Further, the above-described program may be transmitted from the computer including a storage device or the like in which the program is stored through a transmission medium or by a transmission wave of the transmission medium, to the first recording device 101. A "transmission medium" for transmitting a program is a medium having a function of transmitting information, such as a network (communication network) such as the Internet or a communication channel (communication line) such as a telephone line. Further, the above-described program may realize a part of the above-described functions. Furthermore, the above-described program may be a so-called difference file (difference program) that can realize the above-described function in combination with a program already recorded in the computer.

(Configuration of Second Recording Device 102)

Figure 3:
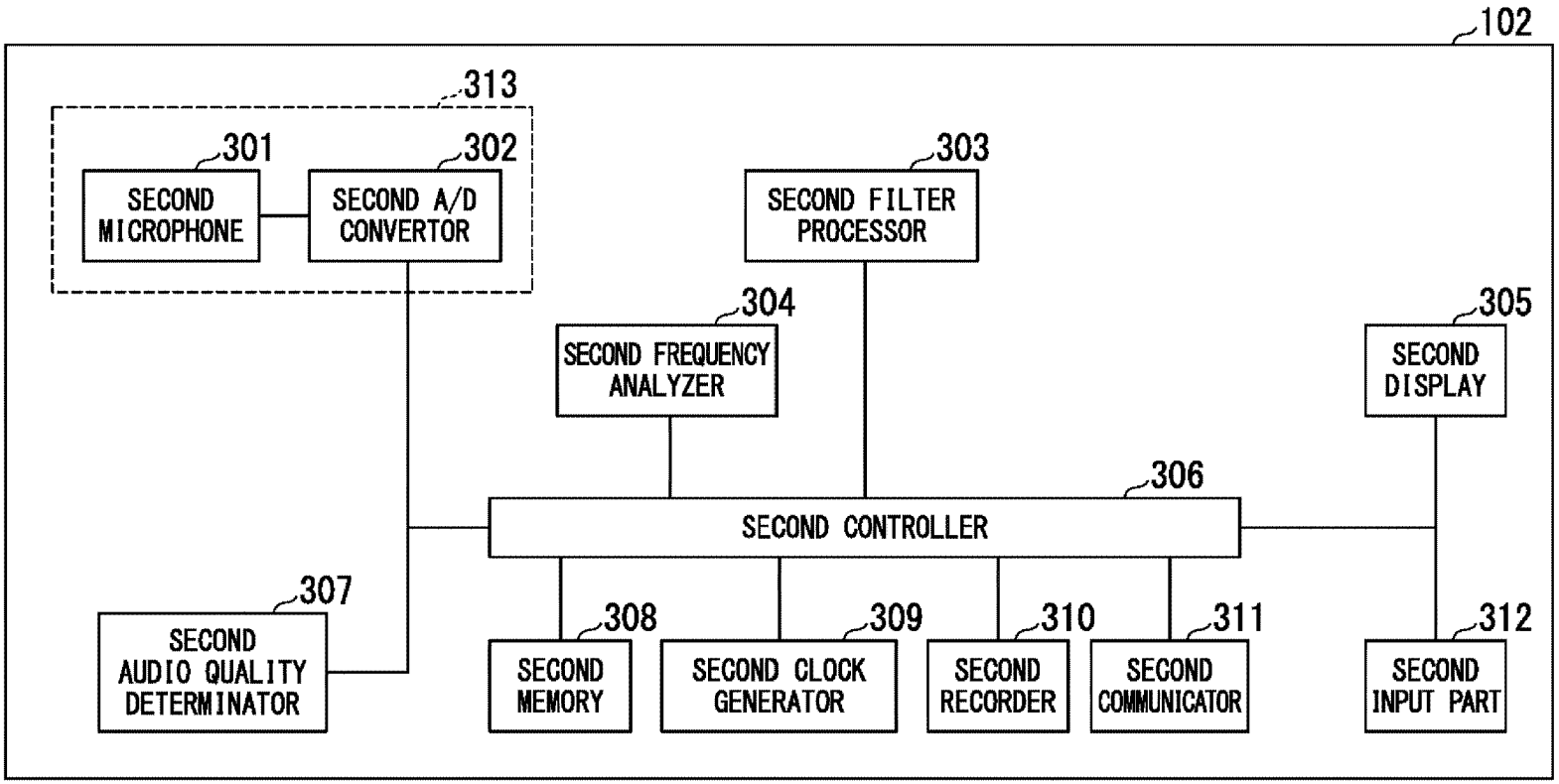
FIG. 3 is a block diagram illustrating a configuration of a second recording device according to the embodiment of the present invention.

FIG. 3 illustrates a configuration of the second recording device 102. As illustrated in FIG. 3, the second recording device 102 includes a second microphone 301, a second A/D converter 302, a second filter processor 303, a second frequency analyzer 304, a second display 305, a second controller 306, a second audio quality determinator 307, a second memory 308, a second clock generator 309, a second recorder 310, a second communicator 311, and a second input part 312.

The second microphone 301 collects audio from sound sources present in the vicinity omnidirectionally, and obtains a second analog signal.

The second A/D converter 302 converts the second analog signal obtained by the second microphone 301 into digital data, that is, second audio data based on the sampling frequency and the number of quantization bits. The sampling frequency, which is one of the sampling conditions, is a previously prepared parameter value such as 48 kHz/96 kHz/192 kHz. The number of quantization bits, which is one of the sampling conditions, is a previously prepared parameter value such as 16 bits/32 bits.

The second microphone 301 and the second A/D converter 302 constitute a second audio input part 313. The second audio is input to the second audio input part 313. The second audio input part 313 generates second audio data from the input second audio. The second directivity of the audio input of the second audio input part 313 is wider than the first directivity of the first audio input part 216. In this example, the second directivity of the audio input of the second audio input part 313 is omnidirectional.

The second frequency analyzer 304 performs second frequency analysis on the second audio data for each of a plurality of analysis ranges and generates second result information indicating the result of second frequency analysis for each of the plurality of analysis ranges. Specifically, the second frequency analyzer 304 analyzes the frequency characteristics of audio included in the second audio data by performing Fourier transform on the second audio data. The second frequency analyzer 304 obtains the frequency information of audio included in the second audio data, and the second result information including the amplitude information and phase information for each frequency. The analysis range is the range of the second audio data obtained in a predetermined period. The second frequency analyzer 304 performs second frequency analysis on each of the plurality of analysis ranges of the second audio data.

The second filter processor 303 generates a second filter for filtering the data of the noise band for each of a plurality of analysis ranges. The second filter processor 303 applies the second filter process by the second filter on the second audio data for each of the plurality of analysis ranges. Thus, the second filter processor 303 generates fourth audio data for each of the plurality of analysis ranges. That is, the second filter processor 303 generates the fourth audio data from the second audio data for each of the plurality of analysis ranges.

The second audio quality determinator 307 determines the second audio quality of the second audio data based on the audio quality information received from the first recording device 101. When an analog signal is converted into digital data, the quality of the digital data changes depending on the values of the sampling frequency and the number of quantization bits. The second audio quality determinator 307 determines sampling conditions at this time. The audio quality information is received from the first recording device 101.

The second memory 308 temporarily stores information for managing the operation state of the inside of the system during the execution of recording, and second audio data generated by the second A/D converter 302. The second clock generator 309 generates a system clock that counts the reference time, that is, the system time used inside the second recording device 102. The second recorder 310 records the fourth audio data generated by the second filter processor 303. The second recorder 310 has a recording medium on which the fourth audio data is recorded. Alternatively, the recording medium on which the fourth audio data is recorded is connected to the second recorder 310.

The second communicator 311 and the first recording device 101, which is another recording device, constitute a wired network or a wireless network. Specifically, the second communicator 311 transmits the second audio data to the first recording device 101. The second communicator 311 further receives audio quality information from the first recording device 101. The second communicator 311 further receives information on the second start position and the analysis range from the first recording device 101 for each of the plurality of analysis ranges. The second communicator 311 further transmits second result information to the first recording device 101 for each of the plurality of analysis ranges. The second communicator 311 further receives information on the noise band from the first recording device 101 for each of the plurality of analysis ranges.

The second display 305 displays a list of second audio quality information that can be set in the second recording device 102. The second input part 312 is a user interface that accepts an input from the user. The second input part 312 accepts the selection of the second audio quality information from the user, after the list of second audio quality information is displayed on the second display 305.

The second controller 306 controls each unit of the second recording device 102. For example, the second controller 306 reads a program including an instruction that defines the operation of the second controller 306, and executes the read program. The realization aspect of this program is the same as the realization aspect of the program realizing the function of the first controller 206 illustrated in FIG. 1.

(Entire Process)

Figure 4:
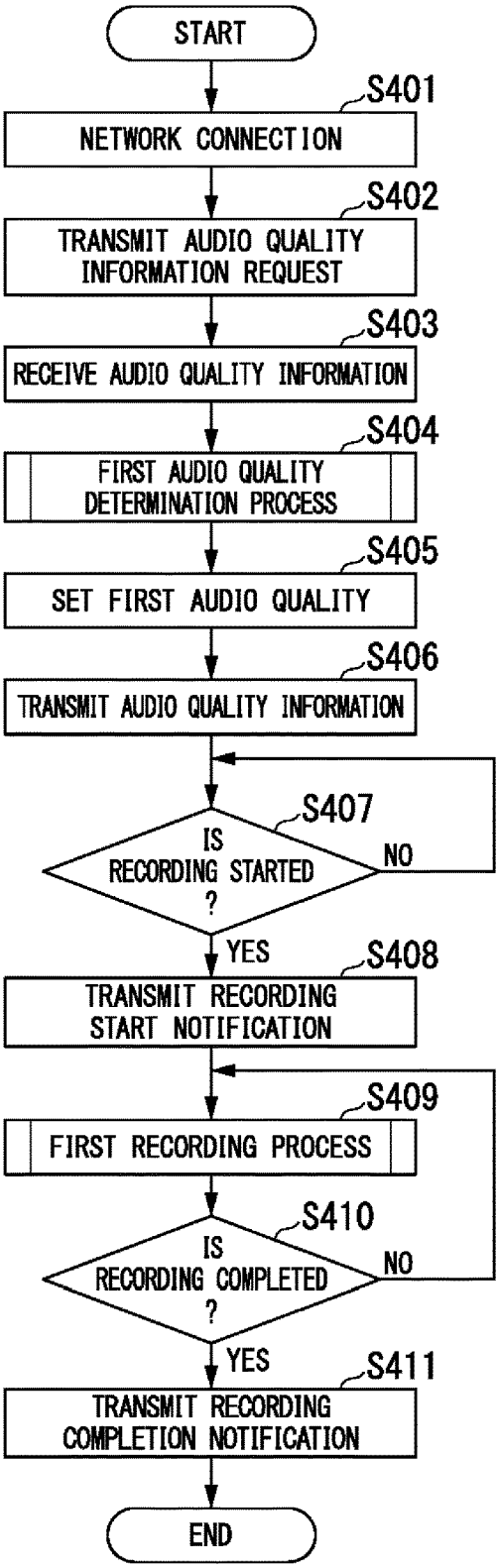
FIG. 4 is a flowchart illustrating a procedure of an entire process performed by the first recording device according to the embodiment of the present invention.
Figure 5:
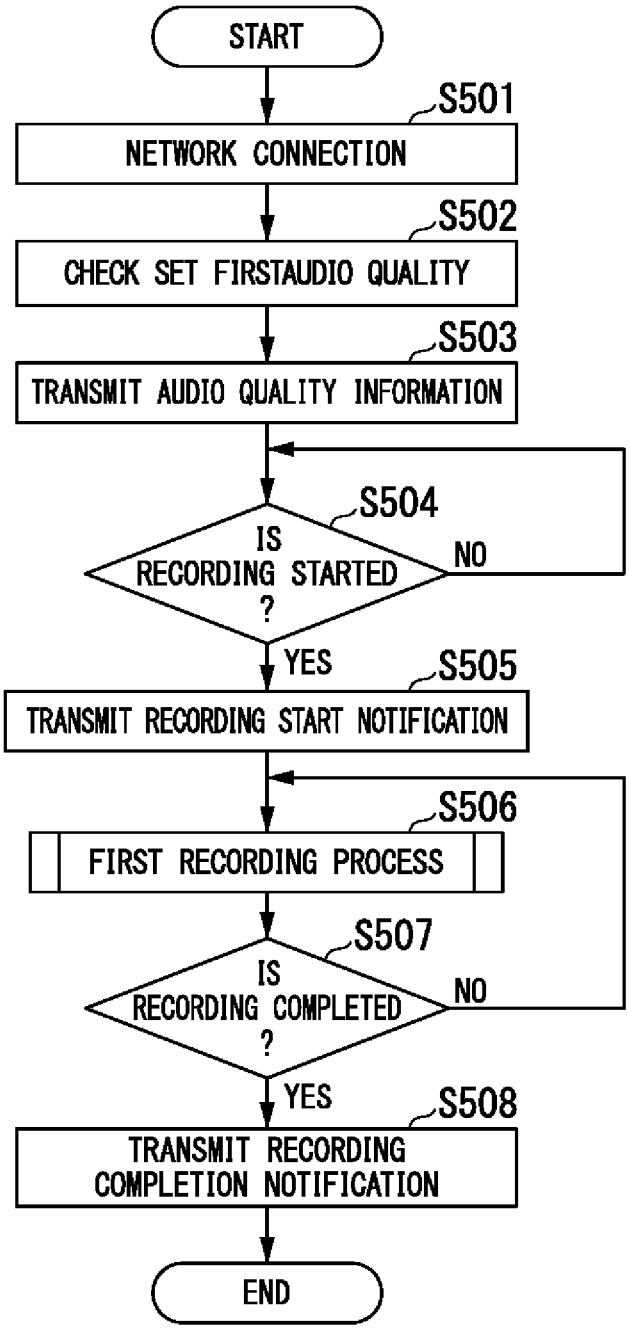
FIG. 5 is a flowchart illustrating a procedure of an entire process performed by the first recording device according to the embodiment of the present invention.
Figure 6:
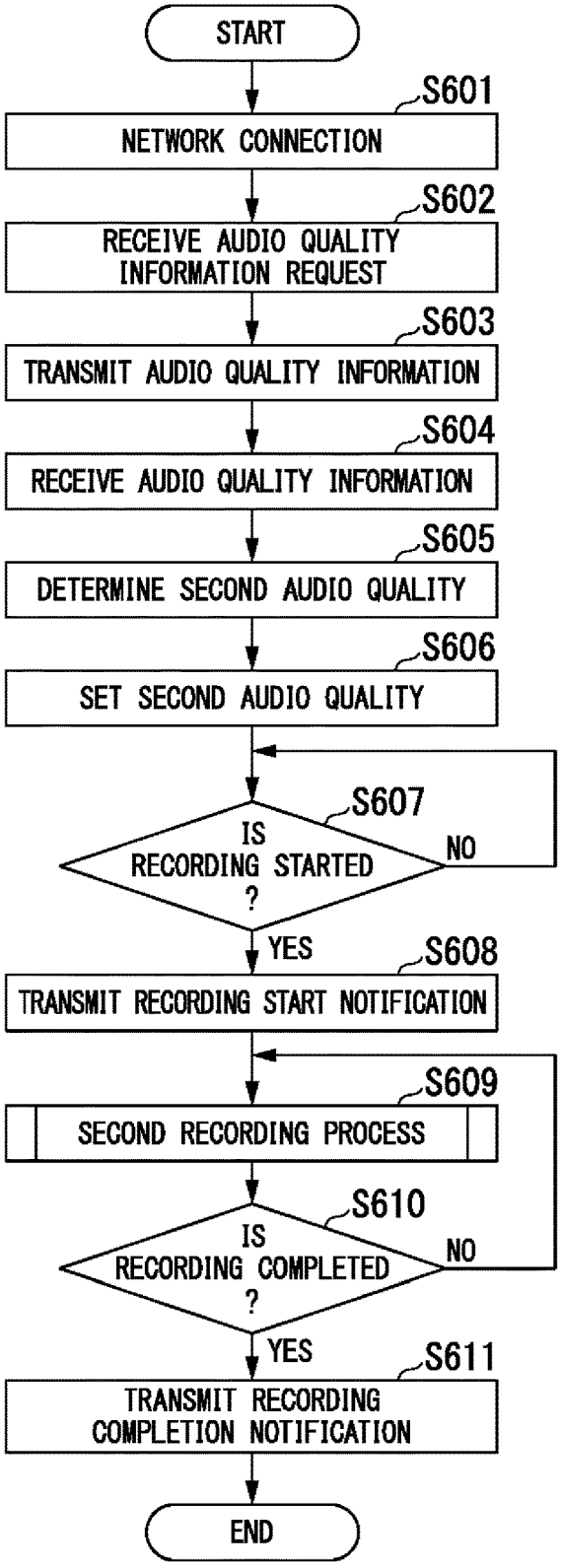
FIG. 6 is a flowchart illustrating a procedure of an entire process performed by the second recording device according to the embodiment of the present invention.
Figure 7:
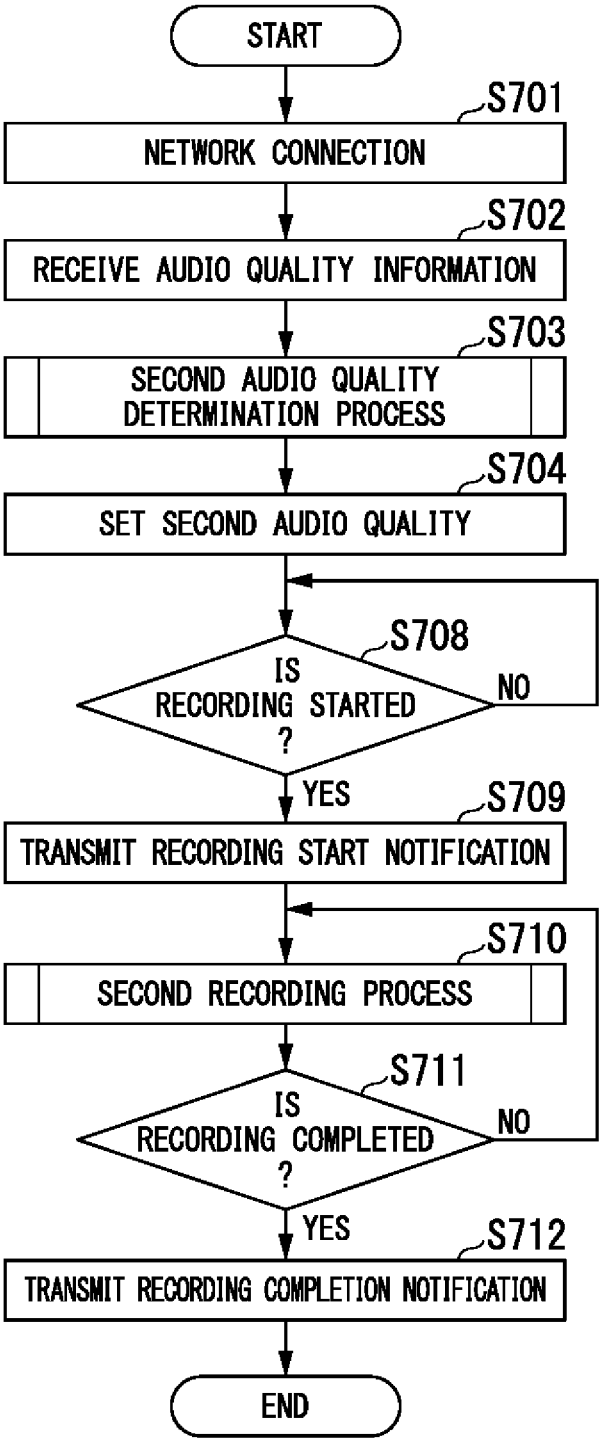
FIG. 7 is a flowchart illustrating a procedure of an entire process performed by the second recording device according to the embodiment of the present invention.

FIG. 4 and FIG. 5 illustrate the procedure of the entire process performed by the first recording device 101. FIG. 6 and FIG. 7 illustrate the procedure of the entire process performed by the second recording device 102. A first example and a second example will be described below. FIG. 4 and FIG. 6 correspond to the first example. FIG. 5 and FIG. 7 correspond to the second example.

First Example

FIG. 4 illustrates the procedure of the entire process performed by the first recording device 101 in the first example. The first communicator 211 establishes a network connection with the second recording device 102 (step S401). Thus, the first recording device 101 and the second recording device 102 are ready for data communication with each other. For example, in a case where a wireless network connection is established through a wireless LAN, network information common to the second recording device 102 is set in the first recording device 101. The first communicator 211 establishes a wireless network connection based on the network information.

After the first recording device 101 is connected to the network and is ready for data communication with the second recording device 102, the first controller 206 generates an audio quality information request and transmits the generated audio quality information request to the first communicator 211. The first communicator 211 transmits an audio quality information request to the second recording device 102 (step S402). The audio quality information request is a message indicating a request for audio quality information. The audio quality information indicates sampling conditions supported by each recording device. For example, the audio quality information is a combination of a sampling frequency and the number of quantization bits. The audio quality information is information indicating one of 48 kHz/16 bit, 96 kHz/16 bit, and 192 kHz/32 bit. For example, 48 kHz/16 bits indicates that the sampling is performed in a state where the sampling frequency is set to 48 kHz and the number of quantization bits is set to 16 bits. The meanings of 96 kHz/16 bits and 192 kHz/32 bits are the same as above.

The first recording device 101 waits for a response from the second recording device 102, after the audio quality information request is transmitted. The first communicator 211 receives a plurality of pieces of audio quality information on all audio qualities supported by the second recording device 102 (step S403). The received plurality of pieces of audio quality information are output to the first audio quality determinator 207 through the first controller 206.

The first recording device 101 performs a first audio quality determination process based on a plurality of pieces of audio quality information indicating a plurality of sampling conditions supported by the first recording device 101 and a plurality of pieces of audio quality information received from the second recording device 102 (step S404). In the first audio quality determination process, the first audio quality and the second audio quality when the first recording device 101 and the second recording device 102 perform recording are determined. In step S404, the first recording device 101 sets the first audio quality and the second audio quality such that the second audio quality when the second recording device 102 performs recording is different from the first audio quality when the first recording device 101 performs recording.

Figure 8:
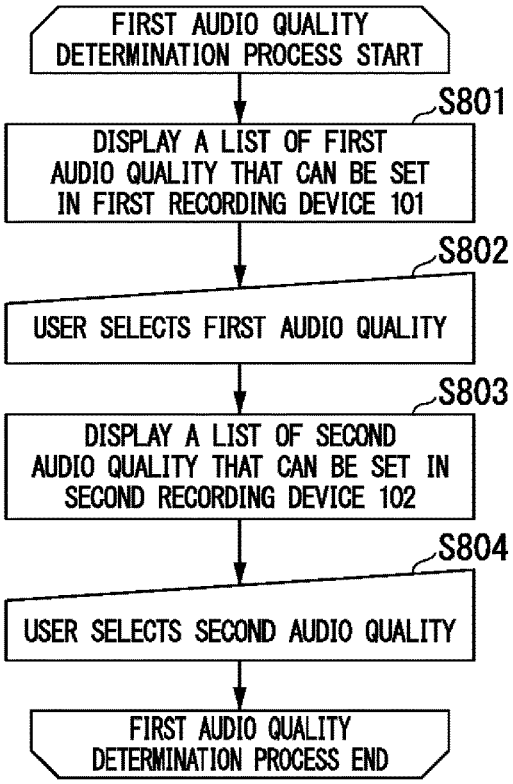
FIG. 8 is a flowchart illustrating a procedure of a first audio quality determination process performed by the first recording device according to the embodiment of the present invention.
Figure 9:
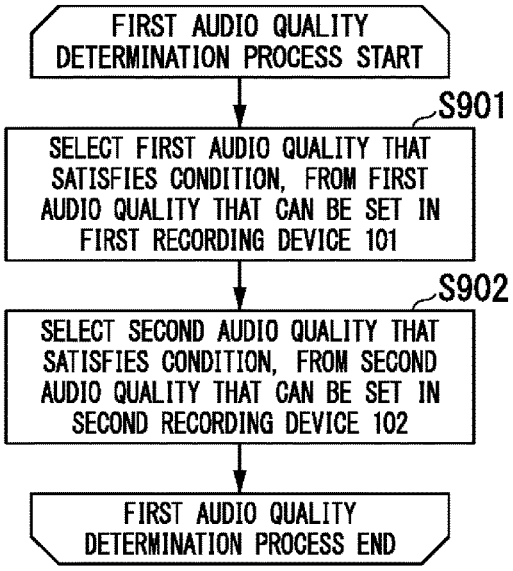
FIG. 9 is a flowchart illustrating a procedure of a first audio quality determination process performed by the first recording device according to the embodiment of the present invention.

The first audio quality determination process will be described with reference to FIGS. 8 and 9. FIG. 8 illustrates the procedure of the first audio quality determination process in a case where the user selects the first audio quality and the second audio quality using the first recording device 101 before the recording process is started.

The first controller 206 causes the first display 205 to display a list of a plurality of first audio qualities supported by the first recording device 101 (step S801). For example, a plurality of pieces of audio quality information corresponding to a plurality of first audio qualities supported by the first recording device 101 are stored in the non-volatile memory of the first recording device 101. In step S801, the first controller 206 reads a plurality of pieces of audio quality information from the non-volatile memory, and outputs the read plurality of pieces of audio quality information to the first display 205. The first display 205 displays a plurality of first audio qualities based on the plurality of pieces of audio quality information. For example, a plurality of first audio qualities such as 48 kHz/16 bits, 96 kHz/16 bits, or 192 kHz/32 bits is displayed as a character string arranged on the list such that the user can understand them.

The user selects a desired first audio quality from the list of a plurality of first audio qualities displayed on the first display 205. Information indicating the selected first audio quality is input to the first input part 212. The first audio quality determinator 207 acquires the information input to the first input part 212, through the first controller 206. The first audio quality determinator 207 determines the audio quality indicated by the acquired information as the first audio quality (step S802).

After the first audio quality is determined, the first controller 206 causes the first display 205 to display a list of a plurality of second audio qualities supported by the second recording device 102 (step S803). In step S803, the first controller 206 outputs the plurality of pieces of audio quality information received in step S403 to the first display 205. The first display 205 displays a plurality of second audio qualities based on the plurality of pieces of audio quality information. For example, a plurality of second audio qualities such as 48 kHz/16 bits, 96 kHz/16 bits, or 192 kHz/32 bits is displayed as a character string arranged on the list such that the user can understand them.

The user selects a desired second audio quality from the list of a plurality of second audio qualities displayed on the first display 205. Information indicating the selected second audio quality is input to the first input part 212. The first audio quality determinator 207 acquires the information input to the first input part 212, through the first controller 206. The first audio quality determinator 207 determines the audio quality indicated by the acquired information as the second audio quality (step S804).

The second audio quality when the second recording device 102 performs recording is different from the first audio quality set in the first recording device 101. In order to select the second audio quality different from the first audio quality, the first recording device 101 may be configured as follows.

In step S803, the first display 205 may not display the same second audio quality as the first audio quality which is selected for the first recording device 101 from the second audio quality supported by the second recording device 102. Alternatively, in step S803, the first display 205 may display only the second audio quality of a lower sound quality than the first audio quality which is selected for the first recording device 101 from the second audio quality supported by the second recording device 102. For example, in a case where 192 kHz/32 bits is selected as the first audio quality for the first recording device 101, only 96 kHz/16 bits and 48 kHz/16 bits may be displayed as the second audio quality.

The first audio quality determinator 207 may select a second audio quality, and the selected second audio quality may be displayed on the first display 205 in step S801. In a case where only the second audio quality of a lower sound quality than the first audio quality is displayed, in step S804, the first audio quality determinator 207 can determine the second audio quality of a lower sound quality than the first audio quality. Further, no particular condition is provided, and in step S803, the first display 205 may display all the second audio quality supported by the second recording device 102.

With the above process, the first recording device 101 can determine the first audio quality and the second audio quality which are desired by the user.

In the process illustrated in FIG. 8, the first audio quality and the second audio quality are selected by the user. As another method, as illustrated in FIG. 9, a method of determining the first audio quality set in the first recording device 101 and the second audio quality set in the second recording device 102 is determined in advance, and the first recording device 101 may determine them while the user does not select them.

The first audio quality determination processing illustrated in FIG. 9 will be described. The first audio quality determinator 207 selects a first audio quality that satisfies the condition from the plurality of first audio qualities supported by the first recording device 101 (step S901). For example, a plurality of pieces of audio quality information corresponding to a plurality of first audio qualities supported by the first recording device 101 are stored in the non-volatile memory of the first recording device 101. In step S901, the first audio quality determinator 207 reads a plurality of pieces of audio quality information from the non-volatile memory through the first controller 206, and selects a first audio quality that satisfies the condition from a plurality of first audio qualities indicated by the read plurality of pieces of audio quality information. Thus, the first audio quality determinator 207 determines the first audio quality.

After the first audio quality is determined, the first audio quality determinator 207 selects a second audio quality that satisfies the condition from a plurality of second audio qualities supported by the second recording device 102 (step S902). For example, a plurality of pieces of audio quality information corresponding to the plurality of second audio qualities supported by the second recording device 102 are stored in the non-volatile memory of the first recording device 101. In step S902, the first audio quality determinator 207 reads a plurality of pieces of audio quality information from the non-volatile memory through the first controller 206, and selects a second audio quality that satisfies the condition from a plurality of second audio qualities indicated by the read plurality of pieces of audio quality information. Thus, the first audio quality determinator 207 determines the second audio quality.

In the above process, the second audio quality is selected according to the first audio quality. For example, in step S901, the first audio quality determinator 207 selects the highest quality among the selectable first audio qualities. In step S902, the first audio quality determinator 207 selects the second audio quality of a lower sound quality than the first audio quality selected in step S901 from the selectable second audio quality. For example, the second audio quality is selected of which the sampling frequency is half of the sampling frequency in the first audio quality and the number of quantization bits is minimum. Alternatively, in step S902, the first audio quality determinator 207 may select the same second audio quality as the first audio quality which is selected in step S901 from the selectable second audio quality. The selection condition may be previously recorded in the first recording device 101 during factory shipment. Alternatively, an initial setting menu is prepared for the first recording device 101, and the user may change the settings of the first audio quality and the second audio quality from the initial setting menu at an arbitrary timing. In either case, in a series of processes in which the recording process is started, a first audio quality and a second audio quality are determined according to the conditions which are already set, as described above.

FIG. 4 will be described again. After the first audio quality determination process is performed, the first audio quality determinator 207 sets the first audio quality determined with the first audio quality determination process, that is, the sampling condition in the first A/D converter 202 (step S405). In addition, the first audio quality determinator 207 generates audio quality information indicating the second audio quality determined through the first audio quality determination process. The first audio quality determinator 207 outputs the audio quality information to the first communicator 211 through the first controller 206. The first communicator 211 transmits audio quality information to the second recording device 102 (step S406).

After the audio quality information is transmitted, the first controller 206 determines the start of recording based on a user's instruction or a notification from the second recording device 102 (step S407). The user's instruction to start recording is input to the first input part 212. In step S407, the first controller 206 determines the start of recording based on the instruction input to the first input part 212 or the information received by the first communicator 211.

In a case where an instruction to start recording is input to the first input part 212, or in a case where a recording start notification instructing to start recording is received by the first communicator 211, the first controller 206 determines that the start of recording is instructed. In a case where an instruction to start recording is not input to the first input part 212 and a recording start notification instructing to start recording is not received by the first communicator 211, the first controller 206 determines that the start of recording is not instructed. When the start of recording is not instructed, the first controller 206 repeats the determination as to the start of recording.

In a case where the start of recording is instructed, the first controller 206 generates a recording start notification, and outputs the generated recording start notification to the first communicator 211. The first communicator 211 transmits the recording start notification to the second recording device 102 (step S408). In a case where the recording start notification is received from the second recording device 102 after the first recording device 101 transmits a recording start notification, the first recording device 101 may ignore the received recording start notification.

After the recording start notification is transmitted, the first recording device 101 performs the first recording process (step S409). The details of the first recording process will be described later. After the first recording process is performed, the first controller 206 determines completion of recording based on a user's instruction or notification from the second recording device 102 (step S410). The user's instruction on the completion of recording is input to the first input part 212. In step S410, the first controller 206 determines the completion of recording based on the instruction input to the first input part 212 or the information received by the first communicator 211.

In a case where an instruction to complete recording is input to the first input part 212, or in a case where a recording completion notification instructing the completion of recording is received by the first communicator 211, the first controller 206 determines that the completion of recording is instructed. In a case where an instruction to complete recording is not input to the first input part 212 and a recording completion notification instructing the completion of recording is not received by the first communicator 211, the first controller 206 determines that the completion of recording is not instructed. In a case where the completion of recording is not instructed, the first controller 206 repeats the first recording process.

In a case where the completion of recording is instructed, the first controller 206 generates a recording completion notification, and outputs the generated recording completion notification to the first communicator 211. The first communicator 211 transmits the recording completion notification to the second recording device 102 (step S411). In a case where the recording completion notification is received from the second recording device 102 after the first recording device 101 transmits the recording completion notification, the first recording device 101 may ignore the received recording completion notification. After the recording completion notification is transmitted, the entire process performed by the first recording device 101 is completed.

FIG. 6 illustrates the procedure of the entire process performed by the second recording device 102 in the first example. The process illustrated in FIG. 6 corresponds to the process illustrated in FIG. 4.

The second communicator 311 establishes a network connection with the first recording device 101 (step S601). Thus, the first recording device 101 and the second recording device 102 are ready for data communication with each other. For example, in a case where a wireless network connection is established through a wireless LAN, network information common to the first recording device 101 is set in the second recording device 102. The second communicator 311 establishes a wireless network connection based on the network information.

After the second recording device 102 is connected to the network and is ready for data communication with the first recording device 101, the second communicator 311 receives an audio quality information request from the first recording device 101 (step S602). The received audio quality information request is output to the second controller 306.

The second controller 306 outputs a plurality of pieces of audio quality information corresponding to all the audio qualities supported by the second recording device 102 to the second communicator 311 based on the audio quality information request. For example, a plurality of pieces of audio quality information corresponding to a plurality of second audio qualities supported by the second recording device 102 are stored in the non-volatile memory of the second recording device 102. The second controller 306 reads a plurality of pieces of audio quality information from the non-volatile memory, and outputs the read plurality of pieces of audio quality information to the second communicator 311. The second communicator 311 transmits the plurality of pieces of audio quality information to the first recording device 101 (step S603).

As described above, the first recording device 101 determines the second audio quality set in the second recording device 102 based on the plurality of pieces of audio quality information from the second recording device 102. In addition, the first recording device 101 transmits audio quality information indicating the determined second audio quality. The second communicator 311 of the second recording device 102 receives audio quality information from the first recording device 101 (step S604). The received audio quality information is output to the second audio quality determinator 307 through the second controller 306.

The second audio quality determinator 307 determines the second audio quality when the second recording device 102 performs recording based on the audio quality information (step S605). The second audio quality indicated by the audio quality information received from the first recording device 101 is the same as the second audio quality determined in step S605. After the second audio quality is determined, the second audio quality determinator 307 sets the determined second audio quality, that is, the sampling condition, in the second A/D converter 302 (step S606).

After the second audio quality is set, the second controller 306 determines the start of recording based on a user's instruction or a notification from the first recording device 101 (step S607). The user's instruction on the start of recording is input to the second input part 312. In step S607, the second controller 306 determines the start of recording based on the instruction input to the second input part 312 or the information received by the second communicator 311.

In a case where an instruction to start recording is input to the second input part 312, or in a case where a recording start notification instructing to start recording is received by the second communicator 311, the second controller 306 determines that the start of recording is instructed. In a case where an instruction to start recording is not input to the second input part 312 or in a case where a recording start notification instructing to start recording is not received by the second communicator 311, the second controller 306 determines that the start of recording is not instructed. In a case where the start of recording is not instructed, the second controller 306 repeats the determination of the start of recording.

When the start of recording is instructed, the second controller 306 generates a recording start notification, and outputs the generated recording start notification to the second communicator 311. The second communicator 311 transmits the recording start notification to the first recording device 101 (step S608). In a case where the recording start notification is received from the first recording device 101 after the second recording device 102 transmits a recording start notification, the second recording device 102 may ignore the received recording start notification.

After the recording start notification is transmitted, the second recording device 102 performs the second recording process (step S609). The details of the second recording process will be described later. After the second recording process is performed, the second controller 306 determines completion of recording based on a user's instruction or notification from the first recording device 101 (step S610). The user's instruction on the completion of recording is input to the second input part 312. In step S610, the second controller 306 determines the completion of recording based on the instruction input to the second input part 312 or the information received by the second communicator 311.

In a case where an instruction to complete recording is input to the second input part 312, or in a case where a recording completion notification instructing the completion of recording is received by the second communicator 311, the second controller 306 determines that the completion of recording is instructed. In a case where an instruction to complete recording is not input to the second input part 312 and a recording completion notification instructing the completion of recording is not received by the second communicator 311, the second controller 306 determines that the completion of recording is not instructed. In a case where the completion of recording is not instructed, the second controller 306 repeats the second recording process.

In a case where the completion of recording is instructed, the second controller 306 generates a recording completion notification, and outputs the generated recording completion notification to the second communicator 311. The second communicator 311 transmits the recording completion notification to the first recording device 101 (step S611). In a case where the recording completion notification is received from the first recording device 101 after the second recording device 102 transmits the recording completion notification, the second recording device 102 may ignore the received recording completion notification. After the recording completion notification is transmitted, the entire process performed by the second recording device 102 is completed.

Second Example

FIG. 5 illustrates the procedure of the entire process performed by the first recording device 101 in the second example. In the process illustrated in FIG. 4, the first audio quality at the time of recording is determined immediately before the recording process. However, in some cases, the first audio quality at the time of recording is set in advance for the first recording device 101. That is, since the first recording device 101 can be used as a recording device alone, the first audio quality at the time of recording may already be set in some cases. The process in this case will be described with reference to FIG. 5.

The first communicator 211 establishes a network connection with the second recording device 102 (step S501). Thus, the first recording device 101 and the second recording device 102 are ready for data communication with each other. For example, in a case where a wireless network connection is established through a wireless LAN, network information common to the second recording device 102 is set in the first recording device 101. The first communicator 211 establishes a wireless network connection based on the network information.

After the first recording device 101 is connected to the network and is ready for data communication with the second recording device 102, the first audio quality determinator 207 checks the first audio quality set in the first A/D converter 202 (step S502). The first audio quality determinator 207 generates audio quality information indicating the first audio quality checked in step S502. The first audio quality determinator 207 outputs the audio quality information to the first communicator 211 through the first controller 206. The first communicator 211 transmits audio quality information to the second recording device 102 (step S503).

After the audio quality information is transmitted, the processes of steps S504 to S508 are performed. The processes of steps S504 to S508 are the same as the processes of steps S407 to S411 in FIG. 4. After the process of step S508 is performed, the entire process performed by the first recording device 101 is completed.

FIG. 7 illustrates the procedure of the entire process performed by the second recording device 102 in the second example. The process illustrated in FIG. 7 corresponds to the process illustrated in FIG. 5.

The second communicator 311 establishes a network connection with the first recording device 101 (step S701). Thus, the first recording device 101 and the second recording device 102 are ready for data communication with each other. For example, in a case where a wireless network connection is established through a wireless LAN, network information common to the first recording device 101 is set in the second recording device 102. The second communicator 311 establishes a wireless network connection based on the network information.

After the second recording device 102 is connected to the network and is ready for data communication with the first recording device 101, the second communicator 311 receives audio quality information from the first recording device 101 (step S702). The received audio quality information is output to the second audio quality determinator 307 through the second controller 306.

The second recording device 102 performs the second audio quality determination process based on a plurality of pieces of audio quality information indicating a plurality of sampling conditions supported by the second recording device 102 and audio quality information received from the first recording device 101 (step S703). In the second audio quality determination process, the second audio quality when the second recording device 102 performs recording is determined. In step S703, the second recording device 102 determines the second audio quality such that the second audio quality when the second recording device 102 performs recording is different from the first audio quality when the first recording device 101 performs recording.

Figure 10:
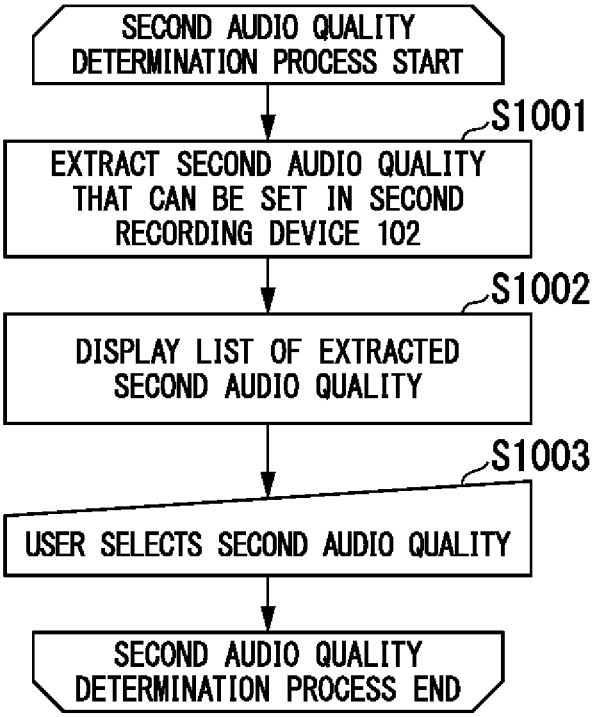
FIG. 10 is a flowchart illustrating a procedure of a second audio quality determination process performed by the second recording device according to the embodiment of the present invention.
Figure 11:
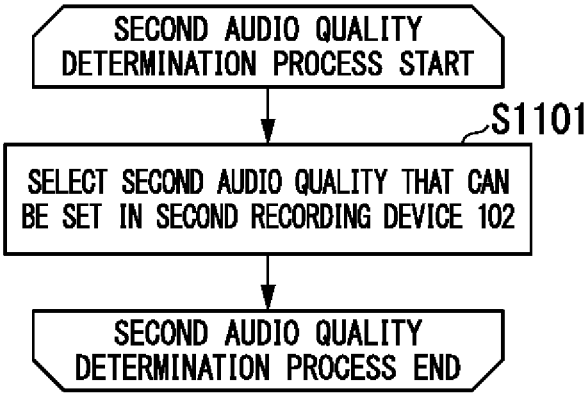
FIG. 11 is a flowchart illustrating the procedure of the second audio quality determination process performed by the second recording device according to the embodiment of the present invention.

The second audio quality determination process will be described with reference to FIGS. 10 and 11. FIG. 10 illustrates the procedure of the second audio quality determination process in a case where the user selects the second audio quality using the second recording device 102 before the recording process is started.

The second audio quality determinator 307 extracts a second audio quality that satisfies the condition from a plurality of second audio qualities supported by the second recording device 102 (step S1001). For example, a plurality of pieces of audio quality information corresponding to a plurality of second audio qualities supported by the second recording device 102 are stored in the non-volatile memory of the second recording device 102. In step S1001, the second audio quality determinator 307 reads a plurality of pieces of audio quality information from the non-volatile memory through the second controller 306, and selects a second audio quality that satisfies the condition from a plurality of second audio qualities indicated by the read plurality of pieces of audio quality information. Thus, the second audio quality determinator 307 extracts the second audio quality. The audio quality information indicating the extracted second audio quality is output to the second controller 306.

The second controller 306 causes the second display 305 to display a list of second audio qualities extracted in step S1001 (step S1002). In step S1002, the second controller 306 outputs audio quality information indicating the second audio quality extracted in step S1001 to the second display 305. The second display 305 displays the second audio quality based on the audio quality information.

The user selects a desired second audio quality from the list of second audio qualities displayed on the second display 305. Information indicating the selected second audio quality is input to the first input part 212. The second audio quality determinator 307 acquires the information input to the second input part 312, through the second controller 306. The second audio quality determinator 307 determines the audio quality indicated by the acquired information as second audio quality (step S1003).

The second audio quality when the second recording device 102 performs recording is different from the first audio quality set in the first recording device 101. In order to select the second audio quality different from the first audio quality, the second recording device 102 may be configured as follows.

In step S1001, the second audio quality determinator 307 may not extract the same second audio quality as the first audio quality which is selected for the first recording device 101 from the second audio qualities supported by the second recording device 102. Alternatively, in step S1001, the second audio quality determinator 307 may extract only the second audio quality of a lower sound quality than the first audio quality which is selected for the first recording device 101 from the second audio quality supported by the second recording device 102. For example, in a case where 192 kHz/32 bits is selected as the first audio quality for the first recording device 101, only 96 kHz/16 bits and 48 kHz/16 bits may be extracted as the second audio quality.

In a case where only the second audio quality of a lower sound quality than the first audio quality is extracted, at step S1003, the second audio quality determinator 307 can determine the second audio quality of a lower sound quality than the first audio quality. Further, no particular condition is provided, and in step S1001, all the second audio qualities supported by the second recording device 102 may be selected.

With the above process, the second recording device 102 can determine the second audio quality desired by the user.

In the process illustrated in FIG. 10, a second audio quality is selected by the user. As another method, as illustrated in FIG. 11, a method of determining the second audio quality set in the second recording device 102 is determined in advance, and the second recording device 102 may determine the audio quality, without the user selecting it.

The second audio quality determination processing illustrated in FIG. 11 will be described. The second audio quality determinator 307 selects a second audio quality that satisfies the condition from the plurality of second audio qualities supported by the second recording device 102 (step S1101). For example, a plurality of pieces of audio quality information corresponding to a plurality of second audio qualities supported by the second recording device 102 are stored in the non-volatile memory of the second recording device 102. In step S1101, the second audio quality determinator 307 reads a plurality of pieces of audio quality information from the non-volatile memory through the second controller 306, and selects a second audio quality that satisfies the condition from a plurality of second audio qualities indicated by the read plurality of pieces of audio quality information. Thus, the second audio quality determinator 307 determines the second audio quality.

In the above process, the second audio quality is selected according to the first audio quality. For example, in step S1101, the second audio quality determinator 307 selects a second audio quality of a lower sound quality than a first audio quality indicated by the audio quality information received from first recording device 101, among selectable second audio qualities. For example, the second audio quality is selected of which the sampling frequency is half of the sampling frequency in the first audio quality and the number of quantization bits is minimum. Alternatively, in step S1101, the second audio quality determinator 307 may select the same second audio quality as the first audio quality indicated by the audio quality information received from the first recording device 101 from the selectable second audio quality. The selection condition may be previously recorded in the second recording device 102 during factory shipment. Alternatively, an initial setting menu is prepared for the second recording device 102, and the user may change the setting of the second audio quality from the initial setting menu at an arbitrary timing. In either case, in a series of processes in which the recording process is started, the second audio quality is determined according to the condition which is already set, as described above.

FIG. 7 will be described again. After the second audio quality determination process is performed, the second audio quality determinator 307 sets the second audio quality determined with the second audio quality determination process, that is, the sampling condition in the second A/D converter 302 (step S704).

After the second audio quality is set, the processes of steps S708 to S712 are performed. The processes of steps S708 to S712 are the same as the processes of steps S607 to S611 in FIG. 6. After the process of step S712 is performed, the entire process performed by the second recording device 102 is completed.

(First Recording Process)

Figure 12:
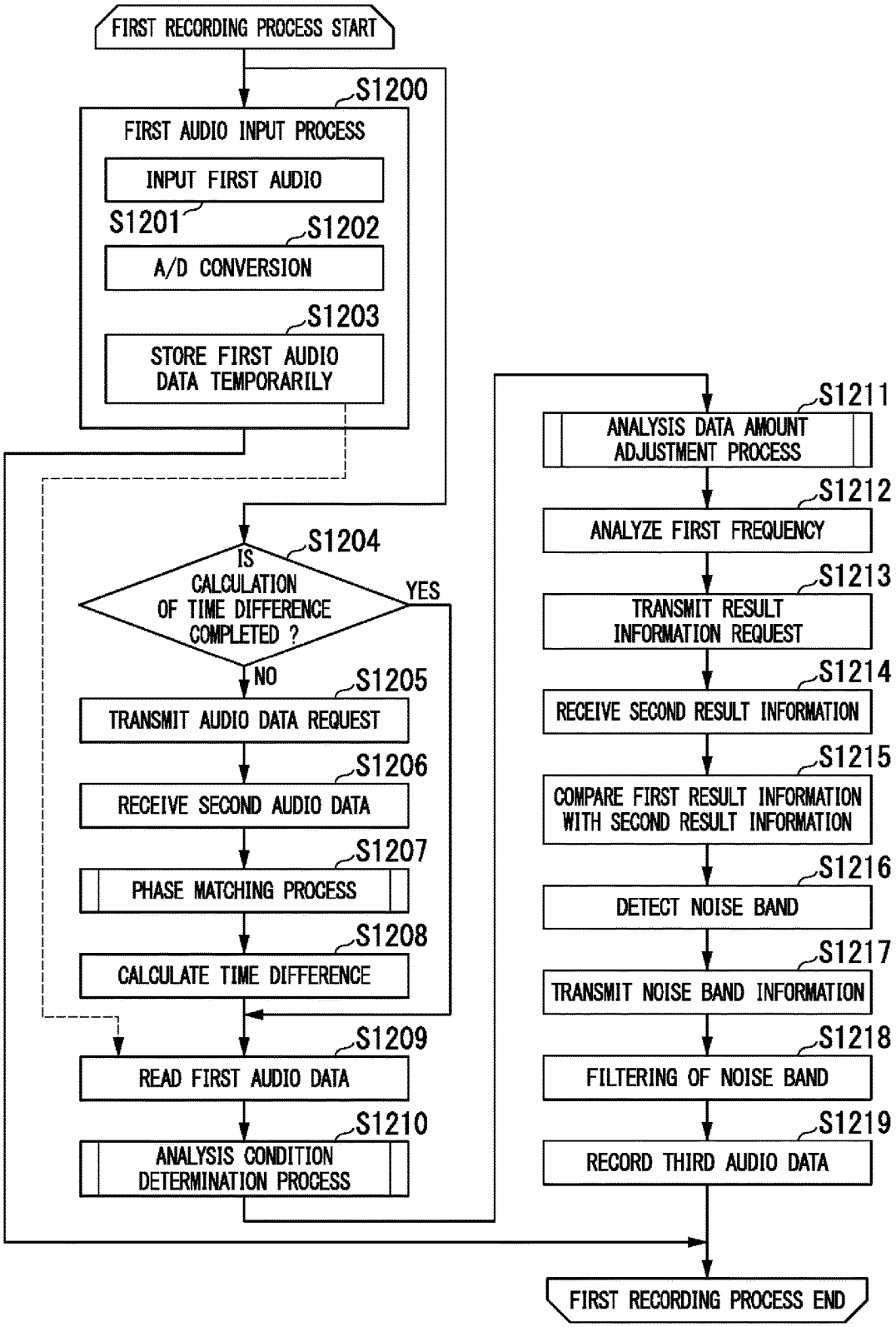
FIG. 12 is a flowchart illustrating a procedure of a first recording process performed by the first recording device according to the embodiment of the present invention.

FIG. 12 illustrates the procedure of the first recording process performed by the first recording device 101. The first recording device 101 executes a plurality of independent processes in parallel, in the first recording process. Some processes are a first audio input process including input of first audio and generation of first audio data. The remaining process is a process for the first audio data. These processes are multitasked asynchronously.

The first audio input process will be described. After the first recording process is started, a first audio input process is performed (step S1200). In the first audio input process, the following process is performed.

The first audio is input to the first microphone 201, and the first microphone 201 outputs a first analog signal based on the first audio (step S1201). The first A/D converter 202 generates first audio data by A/D-converting the first analog signal (step S1202). The sampling condition when the A/D conversion is performed in step S1202 corresponds to the set value of the first audio quality. Further, when the first audio data is generated, time information indicating the collecting time of the first audio is added to the first audio data.

The first audio data generated by the first A/D converter 202 is temporarily stored in the first memory 208 (step S1203). The first audio data temporarily stored in the first memory 208 is read from the first memory 208 when a necessary process is executed. The first audio data on which the process is executed is deleted from the first memory 208.

The process of step S1201, the process of step S1202, and the process of step S1203 are repeatedly executed in parallel until the process of step S1219 is completed.

The process for the first audio data will be described. After the first recording process is started, the first controller 206 determines whether or not the calculation of a time difference is completed (step S1204). The time difference indicates a difference between system times of the first recording device 101 and the second recording device 102. In a case where the time difference is temporarily stored in the first memory 208, the calculation of the time difference is completed. In the case where the time difference is not temporarily stored in the first memory 208, the calculation of the time difference is not completed. In the case where the calculation of the time difference is completed, the process of step S1209 is performed.

In the case where the calculation of the time difference is not completed, the first controller 206 generates an audio data request for requesting the transmission of the second audio data, and outputs the generated audio data request to the first communicator 211. The first communicator 211 transmits the audio data request to the second recording device 102 (step S1205). After the audio data request is transmitted, the first communicator 211 receives second audio data from the second recording device 102 (step S1206). After the second audio data is received, the first recording device 101 performs a phase matching process based on the second audio data received from the second recording device 102 and the first audio data generated by the first recording device 101 (step S1207).

Figure 15:
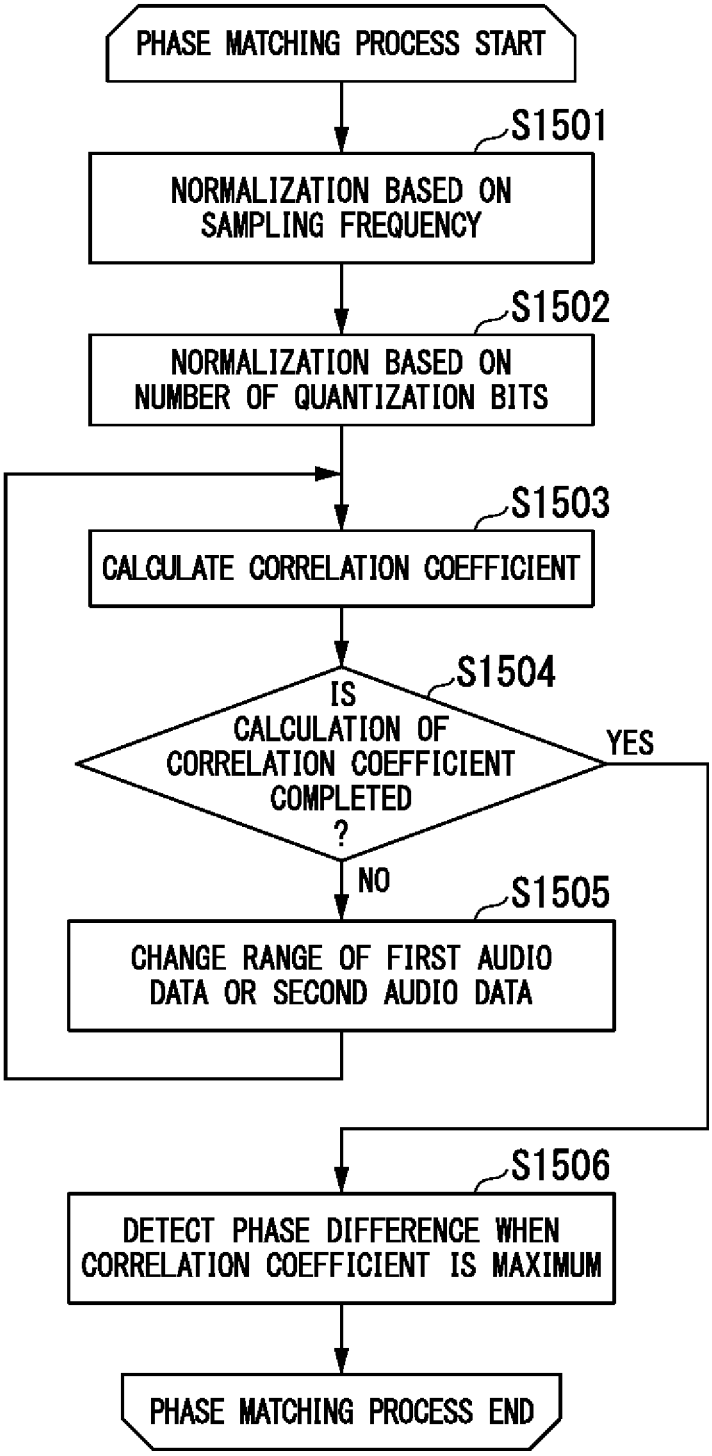
FIG. 15 is a flowchart illustrating a procedure of a phase matching process performed by the first recording device according to the embodiment of the present invention.

The phase matching process will be described with reference to FIG. 15. In the phase matching process, data generated at a predetermined time, including data at the beginning of the first audio data temporarily stored in the first memory 208 are used. Further, data generated at a predetermined time, including data at the beginning of the second audio data received from the second recording device 102, are used.

As a method of matching the phases of two digital data, normalization of digital data is performed. The time difference calculator 214 performs normalization based on the sampling frequency (step S1501). In a case where the sampling frequencies when the first recording device 101 and the second recording device 102 perform recording are different from each other, the numbers of audio data which are generated for audio for one second by the first recording device 101 and the second recording device 102 are different. In order to facilitate the phase matching process, a process of matching these data numbers is performed.

For example, in a case where the sampling frequency of the first recording device 101 is 96 kHz and the sampling frequency of the second recording device 102 is 48 kHz, the number of first audio data is changed such that the number of first audio data matches the number of second audio data. In a case where the sampling frequency is 96 kHz, the number of data included in audio data for one second is 96000. Similarly, in a case where the sampling frequency is 48 kHz, the number of data included in audio data for one second is 48000. Since 96000/48000=2, the time difference calculator 214 halves the number of the first audio data. Specifically, the time difference calculator 214 averages two data which are temporally adjacent to each other in the first audio data and sets them as one data.

After the normalization based on the sampling frequency is performed, the time difference calculator 214 performs normalization based on the number of quantization bits (step S1502). For example, in a case where the number of quantization bits of the first recording device 101 is 32 bits and the number of quantization bits of the second recording device 102 is 16 bits, the time difference calculator 214 cannot simply compare the amplitudes of the audio signals. Therefore, the time difference calculator 214 obtains a coefficient which is the ratio of 32 bits to 16 bits, that is, 2, and multiplies the second audio data by the obtained coefficient.

After normalization based on the number of quantization bits is performed, the time difference calculator 214 calculates a correlation coefficient based on the first audio data and the second audio data (step S1503). The calculation of the correlation coefficient in step S1503 corresponds to a comparison process of comparing first audio data and second audio data. In step S1503, a generally known correlation coefficient calculation method is used. Assuming that the data string constituting the first audio data is X, the data string constituting the second audio data is Y, and X and Y contain n data, the correlation coefficient R can be obtained by the following equation (1). That is, the correlation coefficient R is obtained by dividing the covariance variable between the data string X and the data string Y by the product of the standard deviation of the data string X and the standard deviation of the data string Y.

$$R=(\text{Covariance variable between data string } X \text{ and data string } Y)/(\text{Standard deviation of data string } X \times \text{Standard deviation of data string } Y) \quad (1)$$

After calculating the correlation coefficient, the time difference calculator 214 determines whether or not the calculation of the correlation coefficient is completed by determining whether or not the calculation of the correlation coefficient is performed for a predetermined number of times (step S1504). In a case where the calculation of the correlation coefficient is not completed, the time difference calculator 214 changes the range of the first audio data or the second audio data used for calculating the correlation coefficient (step S1505). After the range of the first audio data or the second audio data is changed, the correlation coefficient is calculated in step S1503.

For example, a method of calculating a correlation coefficient in a case where the first audio data and the second audio data are data corresponding to audio for one second will be described. In the example in a case where the sampling frequency of the first recording device 101 is 96 kHz and the sampling frequency of the second recording device 102 is 48 kHz, the first audio data and the second audio data each has 48000 data. For the sake of convenience, 48000 data have numbers from 1 to 48000 in the order of the time when each data was generated.

The time difference calculator 214 calculates correlation coefficients for data of the numbers 1 to 24000 of the first audio data and data of the numbers 24001 to 48000 of the second audio data. Subsequently, the time difference calculator 214 calculates the correlation coefficient while increasing or decreasing the number of data of the first audio data and the second audio data to be used by one data. A process of increasing or decreasing the number of data of the first audio data and the second audio data to be used by one data corresponds to the process of step S1505.

Specifically, the time difference calculator 214 calculates correlation coefficients for data of the numbers 1 to 24001 of the first audio data and data of the numbers 24000 to 48000 of the second audio data. Subsequently, the time difference calculator 214 calculates correlation coefficients for data of the numbers 1 to 24002 of the first audio data and data of the numbers 23999 to 48000 of the second audio data.

The same process is repeated while increasing the number of data of the first audio data and the second audio data by one. After the same process is repeated, the time difference calculator 214 calculates correlation coefficients for data of the numbers 1 to 48000 of the first audio data and data of the numbers 1 to 48000 of the second audio data. Subsequently, the time difference calculator 214 calculates correlation coefficients for data of the numbers 2 to 48000 of the first audio data and data of the numbers 1 to 47999 of the second audio data.

The same process is repeated while decreasing the number of data of the first audio data and the second audio data by one. After the same process is repeated, the time difference calculator 214 calculates correlation coefficients for data of the numbers 24001 to 48000 of the first audio data and data of the numbers 1 to 24000 of the second audio data. Thus, the calculation of the correlation coefficient is completed.

In a case where the calculation of the correlation coefficient is completed, the time difference calculator 214 calculates the amount of deviation in the time direction between the first audio data and the second audio data used for calculating the maximum correlation coefficient, among the plurality of correlation coefficients, as a phase difference (step S1506). For example, the amount of deviation in the time direction of the start positions of the first audio data and the second audio data used for calculating the maximum correlation coefficient is detected as a phase difference. For example, the amount of deviation in the time direction of the start positions of data of the numbers 1 to 24001 of the first audio data and data of the numbers of 24000 to 48000 of the second audio data is a time corresponding to 23999 data. In a case where audio data is normalized on the basis of the case where the sampling frequency is 48 kHz, the time corresponding to 23999 data is about 500 ms.

The phase difference detected in step S1506 includes the phase difference between the first audio input to the first recording device 101 and the second audio input to the second recording device 102. The reference of the phase of the first audio in the first audio data is the start position of the first audio data. The reference of the phase of the second audio in the second audio data is the start position of the second audio data. Since the positions of the first recording device 101 and the second recording device 102 are substantially the same, the difference in the timings at which audio from the same sound source is input to the first recording device 101 and the second recording device 102 can be ignored. Therefore, the phase difference detected in step S1506 is the difference between the relative position of the first audio with respect to the start position of the first audio data and the relative position of the second audio with respect to the start position of the second audio data. This difference corresponds to the difference between the recording start timings of the first recording device 101 and the second recording device 102. In a case where audio data is normalized on the basis of the case where the sampling frequency is 48 kHz, the phase difference is obtained with an accuracy of about 20 μs.

With the above process, it is possible to obtain a phase difference between the first audio data obtained by the first recording device 101 and the second audio data obtained by the second recording device 102.

FIG. 12 will be described again. After the phase matching process is performed, the time difference calculator 214 calculates a difference between system times, that is, a time difference, of the first recording device 101 and the second recording device 102 based on the time information added to the first audio data, the time information added to the second audio data, and the phase difference detected in step S1506 (step S1208). A difference between the time information added to the first audio data (for example, the time information of the start data of the first audio data) and the time information added to the second audio data (for example, the time information of the start data of the second audio data) is a difference between the recording start timings of the first recording device 101 and the second recording device 102. A difference between system times of the first recording device 101 and the second recording device 102 is obtained by subtracting the difference between the recording start timings of the first recording device 101 and the second recording device 102 from the phase difference detected in step S1506.

After the time difference is calculated, the time difference calculator 214 reads first audio data from the first memory 208 through the first controller 206 (step S1209). Subsequently, the time difference calculator 214 performs an analysis condition determination process (step S1210).

Figure 14:
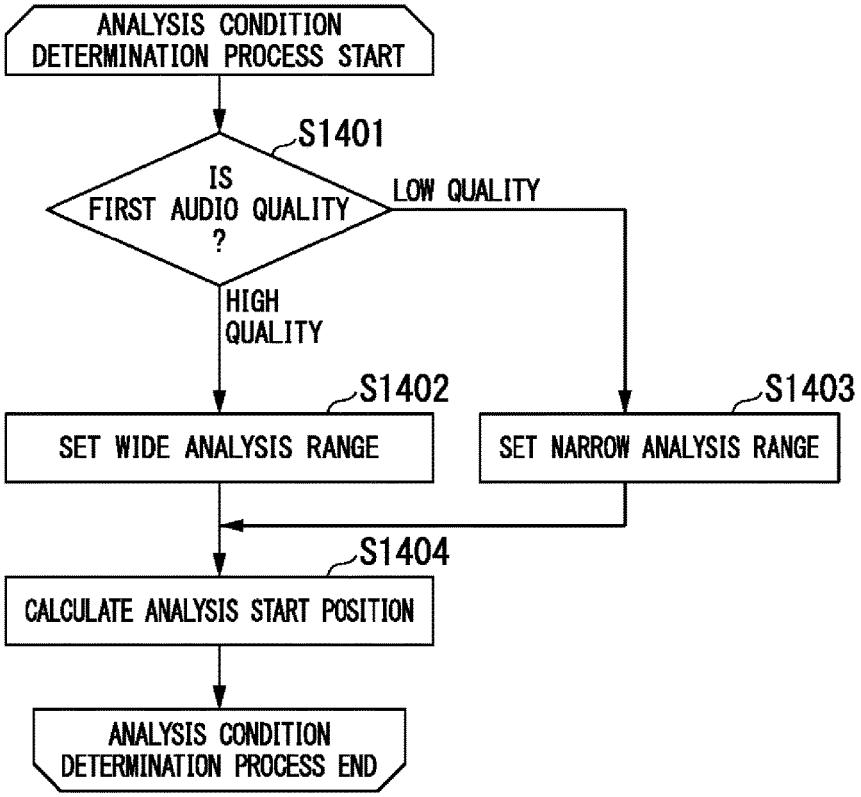
FIG. 14 is a flowchart illustrating an analysis condition determination process performed by the first recording device according to the embodiment of the present invention.

The analysis condition determination process will be described with reference to FIG. 14. The time difference calculator 214 checks the first audio quality currently set in the first recording device 101 (step S1401). In a case where the first audio quality is high sound quality (for example, the sampling frequency is 192 kHz), the time difference calculator 214 sets a relatively wide analysis range (step S1402). Further, in a case where the first audio quality is low sound quality (for example, the sampling frequency is 48 kHz), the time difference calculator 214 sets a relatively narrow analysis range (step S1403).

The analysis range indicates the range of the first audio data in which the first frequency analysis is performed by the first frequency analyzer 204 of the first recording device 101 and the range of the second audio data in which the second frequency analysis is performed by the second frequency analyzer 304 of the second recording device 102. In a case where the first audio quality set in the first recording device 101 is higher than a predetermined audio quality, a relatively wide analysis range is set. Further, in a case where the first audio quality set in the first recording device 101 is lower than the predetermined audio quality, a relatively narrow analysis range is set.

In the embodiment of the present invention, a commonly known Fourier transform is used as a method of frequency analysis for digital data. Due to the characteristics of Fourier transform, resolution increases as data amount increases, and resolution decreases as data amount decreases. Therefore, in a case where frequency analysis is performed on audio data of a high sound quality, a wide analysis range is set in order to perform frequency analysis with as good precision as possible, and the amount of data increases. On the other hand, as the amount of data increases, the amount of calculation increases. Further, the system load increases and the system response decreases. Therefore, in a case where frequency analysis is performed on audio data of a low quality, a processing time for analysis calculation takes precedence. In other words, a narrow analysis range is set and the amount of data is reduced. For example, in a case where a first audio quality is a high sound quality (for example, the sampling frequency is 192 kHz), an analysis range of 10 seconds is set. For example, in a case where the first audio quality is a low sound quality (for example, the sampling frequency is 48 kHz), an analysis range of one second is set. The resolution of the Fourier transform for data of 0.1 second is 10 Hz. The resolution of the Fourier transform for data of 1 second is 1 Hz. The resolution of the Fourier transform for data of 10 seconds is 0.1 Hz.

After the analysis range is set, the time difference calculator 214 calculates an analysis start position (step S1404). The analysis start position includes a first start position and a second start position. The first start position is the position of the first audio data at which the first frequency analysis is started. The second start position is the position of the second audio data at which the second frequency analysis is started.

For example, the first start position in the first frequency analysis at the first time is the start position of the first audio data temporarily stored in the first memory 208. The timing at which the first recording device 101 starts the first recording process may not match the timing at which the second recording device 102 starts the second recording process. Therefore, the first start position in the first frequency analysis at the first time may be a position shifted from the start position of the first audio data temporarily stored in the first memory 208 by a range corresponding to a predetermined time. The predetermined time may be longer than the time assumed as the deviation between the start timing of the first recording process and the start timing of the second recording process.

The first start position in the first frequency analysis at the second time is a position shifted from the first start position in the first frequency analysis at the first time by an analysis range. For example, in a case where the time information added to the first audio data in the first start position in the first frequency analysis at the first time indicates the time T1 and the analysis range is the range corresponding to R seconds, the first start position in the first frequency analysis at the second time is the data position corresponding to the time (T1+R). The first start positions in the first frequency analysis at the third and subsequent times are calculated in the same way.

For example, the second start position in the second frequency analysis at the first time is a data position corresponding to a time shifted by a time difference from the time T1. The second start position in the second frequency analysis at the second time is the position shifted by the analysis range from the second start position in the second frequency analysis at the first time. The second start positions in the second frequency analysis at the third and subsequent times are calculated in the same way.

With the above process, the analysis conditions of the first frequency analysis and the second frequency analysis are determined. The first recording device 101 can set an analysis range suitable for the first audio quality.

FIG. 12 will be described again. After the analysis condition is determined, the first frequency analyzer 204 performs an analysis data amount adjustment process (step S1211). The processing time of analysis calculation is different depending on the system. Therefore, in the analysis data amount adjustment process, the load on the system and the response performance are taken into consideration, and the amount of data is adjusted so that the processing time is an appropriate time. The analysis data amount adjustment process will be described later.

After the analysis data amount adjustment process is performed, the first frequency analyzer 204 performs first frequency analysis on the first audio data of the analysis range based on the first start position to generate first result information indicating the result of the first frequency analysis (step S1212). Since the first recording process is repeated, the first frequency analysis is performed for each of a plurality of different analysis ranges. Further, first result information is generated for each of the plurality of different analysis ranges.

In the first frequency analysis, a commonly known Fourier transform is used, and an analysis calculation is performed on digital data. In a case where reduction of the data amount is designated as the analysis condition, the first frequency analyzer 204 performs the first frequency analysis by reducing the amount of data per second with respect to the first audio data.

After the first frequency analysis is performed, the first controller 206 generates a result information request and outputs the generated result information request to the first communicator 211. The result information request indicates a request for the second result information indicating the result of the second frequency analysis performed by the second recording device 102. The result information request includes information on analysis conditions determined by the analysis condition determination process, that is, the analysis range and the second start position. The first communicator 211 transmits the result information request to the second recording device 102 (step S1213). After the result information request is transmitted, the first communicator 211 receives the second result information from the second recording device 102 (step S1214).

After the second result information is received, the noise band detector 213 compares the first result information with the second result information (step S1215). Subsequently, the noise band detector 213 detects a noise band based on the result of the process of step S1215 (step S1216). Since the first recording process is repeatedly performed, a noise band is detected for each of the plurality of different analysis ranges.

Figure 17A:
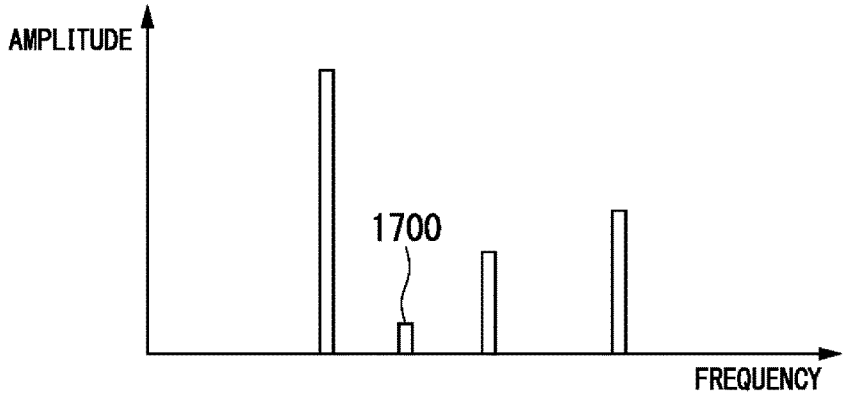
FIG. 17A is a graph illustrating a power spectrum in the embodiment of the present invention.
Figure 17B:
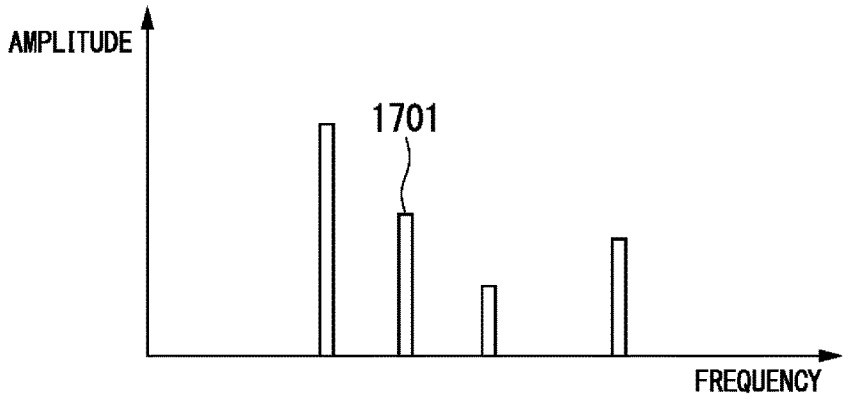
FIG. 17B is a graph illustrating a power spectrum in the embodiment of the present invention.

With reference to FIGS. 17A and 17B, the contents of the process of step S1215 and step S1216 will be described. The first result information and the second result information include frequency information of audio, and amplitude information and phase information for each frequency. FIGS. 17A and 17B graphically illustrate a power spectrum including audio frequency information and amplitude information for each frequency. FIG. 17A illustrates a power spectrum corresponding to the first result information. FIG. 17B illustrates a power spectrum corresponding to the second result information.

The first result information and the second result information include the result of frequency analysis on the data of audio collected at the same time. Therefore, in FIGS. 17A and 17B, peaks appear in the same frequency band. Further, the amplitude 1701 in the same frequency band is larger than the amplitude 1700.

The first recording device 101 mainly collects audio from a target sound source. On the other hand, the second recording device 102 collects audio from sound sources other than the target sound source at a level equivalent to audio from the target sound source. Therefore, with respect to the audio from the target sound source, the peak appearing in the power spectrum obtained by the first frequency analysis becomes larger than the peak appearing in the power spectrum obtained by the second frequency analysis. Further, with respect to the audio from sound sources other than the target sound source, the peak appearing in the power spectrum obtained by the second frequency analysis becomes larger than the peak appearing in the power spectrum obtained by the first frequency analysis. That is, the noise band detector 213 can estimate that the frequency band corresponding to the amplitude 1700 and the amplitude 1701 is based on audio from sound sources other than the target sound source by comparing the amplitude 1700 and the amplitude 1701. That is, the noise band detector 213 can estimate that this frequency band is a noise band.

In step S1215, the noise band detector 213 compares the amplitude for each frequency corresponding to the first result information with the amplitude for each frequency corresponding to the second result information. In step S1216, the noise band detector 213 determines whether or not each frequency band is a noise band based on the result of the comparison.

FIG. 12 will be described again. After the noise band is detected, the noise band detector 213 generates noise band information indicating the detected noise band. The noise band detector 213 outputs the noise band information to the first communicator 211 and the first filter processor 203 through the first controller 206. The first communicator 211 transmits noise band information to the second recording device 102 (step S1217). The noise band information includes information on the estimated frequency, amplitude, and phase.

After the noise band information is transmitted, the first filter processor 203 generates a first filter that filters data of the noise band. The first filter processor 203 further generates third audio data by applying the first filter process by the first filter to the first audio data (step S1218). The third audio data is digital data of first audio from which noise is removed. The first filtering process is performed by a generally known method based on the frequency, amplitude and phase of the noise band. Since the frequency, the amplitude and the phase are known, data of the noise band can be removed from the first audio data by inverting the phase of the digital data of a portion corresponding to the noise band in the first audio data and superimposing the phase-inverted digital data on the first audio data. Since the first recording process is repeatedly performed, a first filter is generated for each of a plurality of different analysis ranges. Further, a first filtering process is performed for each of the plurality of different analysis ranges.

The generated third audio data is output to the first recorder 210 through the first controller 206. The first recorder 210 records third audio data (step S1219).

With the above process, the first recording device 101 can obtain digital data of good audio in which noise from sound sources other than the target sound source is removed.

(Second Recording Process)

Figure 13:
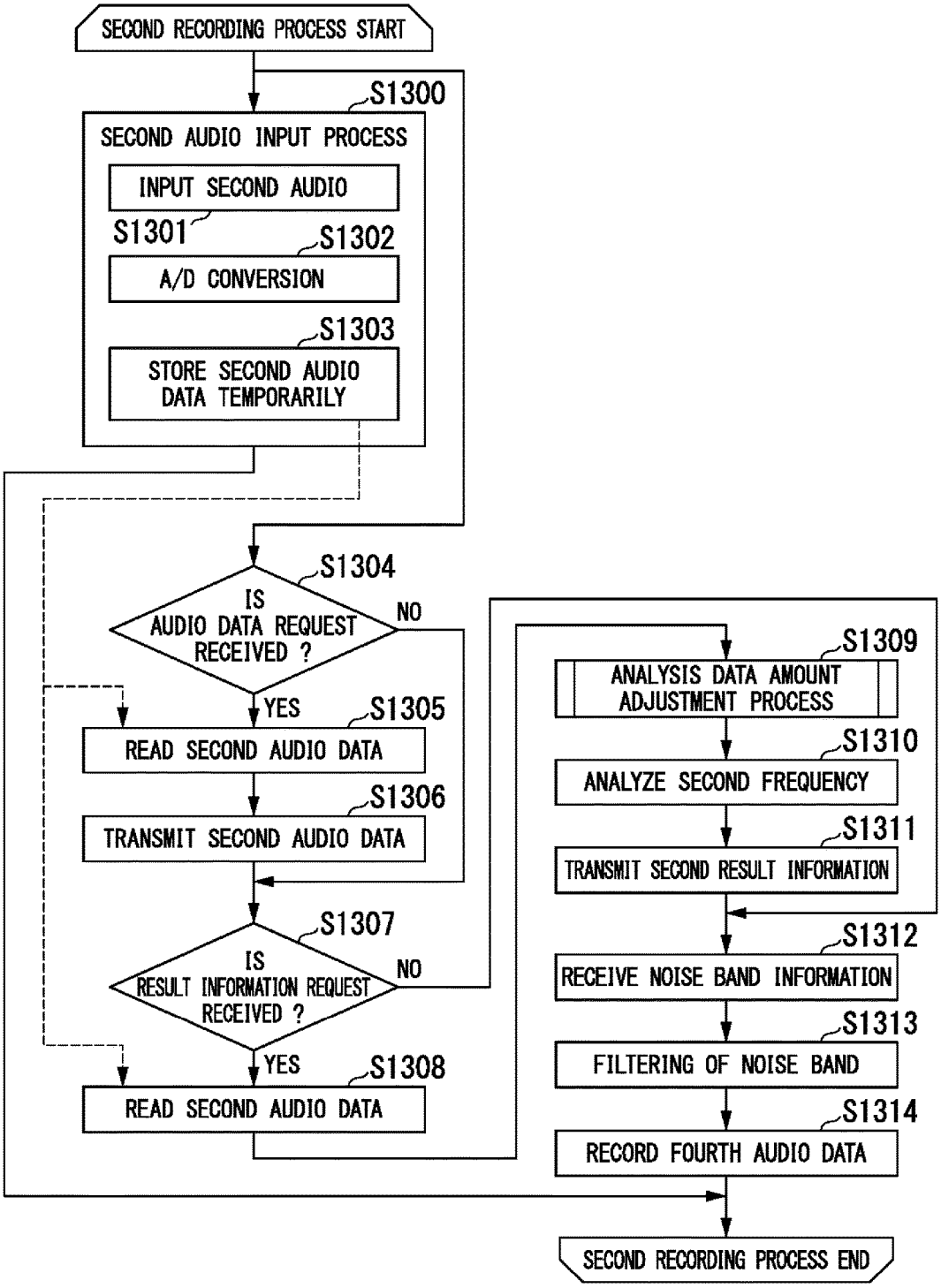
FIG. 13 is a flowchart illustrating a procedure of the second recording process performed by a second recording device according to the embodiment of the present invention.

FIG. 13 illustrates the procedure of the second recording process performed by the second recording device 102. The second recording device 102 executes a plurality of independent processes in parallel, in the second recording process. Some processes are a second audio input process including input of second audio and generation of second audio data. The remaining process is a process for the second audio data. These processes are multitasked asynchronously.

A second audio input will be described. After the second recording process is started, a second audio input process is performed (step S1300). In the second audio input process, the following process is performed.

The second audio is input to the second microphone 301, and the second microphone 301 outputs a second analog signal based on the second audio (step S1301). The second A/D converter 302 generates second audio data by A/D-converting the second analog signal (step S1302). The sampling condition when the A/D conversion is performed in step S1302 corresponds to the set value of a second audio quality. Further, when the second audio data is generated, time information indicating the collecting time of the second audio is added to the second audio data.

The second audio data generated by the second A/D converter 302 is temporarily stored in the second memory 308 (step S1303). The second audio data temporarily stored in the second memory 308 is read from the second memory 308 when a necessary process is executed. The second audio data on which the process is executed is deleted from the second memory 308.

The process of step S1301, the process of step S1302, and the process of step S1303 are repeatedly executed in parallel until the process of step S1314 is completed.

The process for the second audio data will be described. After the second recording process is started, the second controller 306 determines whether an audio data request is received (step S1304). In a case where the audio data request is not received, the process of step S1307 is performed.

In a case where the audio data request is received, the second controller 306 reads the second audio data from the second memory 308 (step S1305). In step S1305, all the second audio data temporarily stored in the second memory 308 are read. Subsequently, the second controller 306 outputs the second audio data to the second communicator 311. The second communicator 311 transmits the second audio data to the first recording device 101 (step S1306).

After the second audio data is transmitted, the second controller 306 determines whether a result information request is received (step S1307). In a case where the result information request is not received, the process of step S1312 is performed. When the result information request is received, the second frequency analyzer 304 reads the second audio data from the second memory 308 through the second controller 306 (step S1308).

Subsequently, the second frequency analyzer 304 performs the analysis data amount adjustment process (step S1309). The processing time of analysis calculation is different depending on the system. Therefore, in the analysis data amount adjustment process, the load on the system and the response performance are taken into consideration, and the amount of data is adjusted so that the processing time is an appropriate time. The analysis data amount adjustment process will be described later.

After the analysis data amount adjustment process is performed, the second frequency analyzer 304 performs second frequency analysis on the second audio data of the analysis range based on the second start position to generate second result information indicating the result of the second frequency analysis (step S1310). The result information request received from the first recording device 101 includes information on the analysis range and the second start position. In step S1310, this information is used. Since the second recording process is repeatedly performed, the second frequency analysis is performed for each of a plurality of different analysis ranges. Further, the second result information is generated for each of the plurality of different analysis ranges.

In the second frequency analysis, Fourier transform is used as in the first frequency analysis, and calculation of analysis is performed on the digital data. In a case where reduction of the data amount is designated as the analysis condition, the second frequency analyzer 304 performs the second frequency analysis by reducing the amount of data per second with respect to the second audio data.

After the second frequency analysis is performed, the second frequency analyzer 304 outputs the second result information to the second communicator 311 through the second controller 306. The second communicator 311 transmits the second result information to the first recording device 101 (step S1311). After the second result information is transmitted, the second communicator 311 receives the noise band information from the first recording device 101 (step S1312). The received noise band information is output to the second filter processor 303 through the second controller 306.

The second filter processor 303 generates a second filter that filters data of the noise band. The second filter processor 303 further applies the second filter process by the second filter to the second audio data to generate fourth audio data (step S1313). The fourth audio data is the digital data of the second audio from which the noise is removed. Since the frequency, the amplitude and the phase are known, data of the noise band can be removed from the second audio data, by inverting the phase of the digital data of a portion corresponding to the noise band in the second audio data and superimposing the phase-inverted digital data on the second audio data. Since the second recording process is repeatedly performed, a second is generated for each of a plurality of different analysis ranges. Further, a second filtering process is performed for each of the plurality of different analysis ranges.

The generated fourth audio data is output to the second recorder 310 through the second controller 306. The second recorder 310 records the fourth audio data (step S1314).

With the above process, the second recording device 102 can obtain digital data of good audio in which noise from sound sources other than the target sound source is removed. In addition, the second recording device 102 can obtain digital data of a second audio quality different from the first audio quality in the first audio data obtained by the first recording device 101.

(Analysis Data Amount Adjustment Process)

Figure 16:
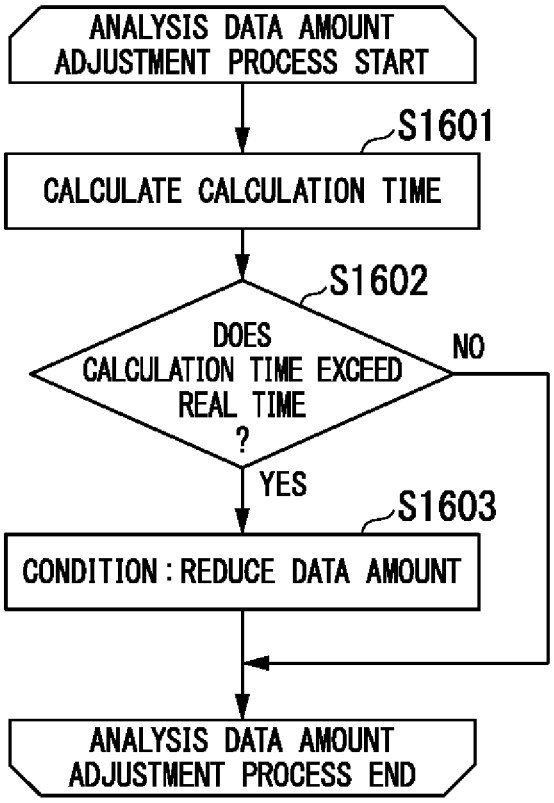
FIG. 16 is a flowchart illustrating a procedure of an analysis data amount adjustment process performed by the first recording device and the second recording device according to the embodiment of the present invention.

An analysis data amount adjustment process will be described with reference to FIG. 16. The first frequency analyzer 204 or the second frequency analyzer 304 calculates the calculation time associated with the Fourier transform when performing frequency analysis on the digital data (step S1601). When Fast Fourier Transform (FFT) is used for frequency analysis, the number of calculations for data of which the data amount is N can be obtained by 2N log 2N. For example, in a case where the CPU performs an operation and the CPU clock is 1 GHz, the execution time of one instruction is 1 ns. For example, in a case where 20 instructions are required to compute the Fast Fourier Transform, one computation time is 20 ns. In a case where digital data is data acquired for one second with a sampling frequency of 48 kHz, the number of calculations of Fast Fourier Transform is 1492872 according to the above equation. This calculation time is about 300 ms.

The calculation time varies depending on the system. In order to secure the response performance of the recording process, the first frequency analyzer 204 or the second frequency analyzer 304 checks whether or not the calculation time exceeds the real time of the digital data (step S1602). In a case where the calculation time does not exceed the real time of the digital data, the analysis data amount adjustment process is completed. In a case where the calculation time exceeds the real time of the digital data, the first frequency analyzer 204 or the second frequency analyzer 304 determines the condition for adjusting the data amount (step S1603).

For example, in a case where the resolution required for a high sound quality is 0.1 Hz, the data amount of about 10 seconds is necessary. In a case where the CPU clock is 1 GHz, the calculation time of data for 10 seconds sampled at 192 kHz sampling frequency is about 1.6 seconds. Therefore, since the calculation time does not exceed the real time in this case, there is no problem.

On the other hand, in a case where the CPU clock is 100 MHz under the above conditions, the calculation time is about 16 seconds. In this case, since the calculation time exceeds the real time, it is necessary to adjust the data amount. In this case, when frequency analysis by fast Fourier transform is performed, the first frequency analyzer 204 or the second frequency analyzer 304 reduces the number of data per second of digital data. Specifically, the first frequency analyzer 204 or the second frequency analyzer 304 multiplies the data amount per second by ½ or ¼. After the amount of data is reduced in this manner, the first frequency analyzer 204 or the second frequency analyzer 304 recalculates the calculation time and rechecks whether or not the calculation time exceeds the real time. The data amount is reduced by averaging neighboring data. In the case of the above conditions, if the data amount per second becomes ½, the calculation time is about 7.6 seconds. This calculation time does not exceed real time.

The first frequency analyzer 204 or the second frequency analyzer 304 performs this process as necessary, when performing frequency analysis. This reduces the data amount, and shortens the calculation time.

With the above process, the first recording device 101 or the second recording device 102 can adjust the data amount of the first audio data or the second audio data such that the calculation time does not exceed the real time of the digital data.

In the embodiment of the present invention, the first recording device 101 includes a time difference calculator 214. However, the second recording device 102 may have the same configuration as the time difference calculator 214. In a case where the second recording device 102 has the same configuration as the time difference calculator 214, the first recording process illustrated in FIG. 12 and the second recording process illustrated in FIG. 13 are changed as follows.

For example, in the first recording process, the processes of steps S1204 to S1208 are not performed. Further, before the process of step S1209 is performed, the same processes as the processes of steps S1304 to S1306 are performed. Further, information on the time difference is received from the second recording device 102.

For example, in the second recording process, the processes of steps S1304 to S1306 are not performed. Further, before the process of step S1307 is performed, the same processes as the processes of steps S1204 to S1208 are performed. Further, information on the time difference is transmitted to the first recording device 101.

According to an embodiment of the present invention, the first recording device 101 is configured to include the first audio input part 216, the first communicator 211, the first frequency analyzer 204, the condition determinator 215, the noise band detector 213, the first filter processor 203, and the first recorder 210.

In addition, according to the embodiment of the present invention, the second recording device 102 is configured to include the second audio input part 313, the second communicator 311, the second frequency analyzer 304, the second filter processor 303, and the second recorder 310.

Further, according to the embodiment of the present invention, the recording system 10 is configured to include the first recording device 101 and the second recording device 102.

Further, according to the embodiment of the present invention, the first recording method is configured to include the first audio input step (step S1200), the first frequency analysis step (step S1212), the condition determination step (step S1210), the noise band detection step (step S1216), the first filtering process step (step S1218), the first recording step (step S1219), the first transmission step (step S1213), the reception step (step S1214), and the second transmission step (step S1217).

Further, according to the embodiment of the present invention, the second recording method is configured to include the second audio input step (step S1300), the second frequency analysis step (step S1310), the second filtering process step (step S1313), the second recording step (step S1314), the first reception step (step S1307), the transmission step (step S1311), and the second reception step (step S1312).

Further, according to the embodiment of the present invention, the first recording program is configured to cause the computer of the first recording device 101 to execute the first audio input step (step S1200), the first frequency analysis step (step S1212), the condition determination step (step S1210), the noise band detection step (step S1216), the first filtering process step (step S1218), the first recording step (step S1219), the first transmission step (step S1213), the reception step (step S1214), and the second transmission step (step S1217).

Further, according to the embodiment of the present invention, the second recording program is configured to cause the computer of the second recording device 102 to execute the second audio input step (step S1300), the second frequency analysis step (step S1310), the second filtering process step (step S1313), the second recording step (step S1314), the first reception step (step S1307), the transmission step (step S1311), and the second reception step (step S1312).

In the embodiment of the present invention, in a system including a plurality of independent recording devices, it is possible to obtain two audio data with reduced noise. Further, the first recording device 101 and the second recording device 102 can obtain digital data of different audio quality.

Further, the first start position of the first frequency analysis and the second start position of the second frequency analysis are determined based on the difference between system times. Therefore, even in a case where the system times of the first recording device 101 and the second recording device 102 do not match, first frequency analysis and second frequency analysis are performed on the first audio data and the second audio data corresponding to the same period. As a result, the first recording device 101 can detect a noise band for accurately reducing noise.

Although the embodiments of the present invention have been described in detail with reference to the drawings, specific configurations are not limited to the above-described embodiments, and design changes and the like within the scope without deviating from the gist of the present invention are included.

The present invention can be widely applied to a technique of recording using a plurality of recording devices, and it is possible to obtain two audio data with reduced noise, in a system having a plurality of independent recording devices.

What is claimed is:

1. A first recording device, comprising:

a first audio input part configured to receive first audio, and generate first audio data from the received first audio;

a first communicator;

a first frequency analyzer configured to perform first frequency analysis on the first audio data for each of a plurality of analysis ranges, and generate first result information indicating a result of the first frequency analysis for each of the plurality of analysis ranges;

a condition determinator configured to determine a first start position and a second start position, determine the analysis range in accordance with a first audio quality of the first audio data, the first start position being a position of the first audio data at which the first frequency analysis is started, the second start position being a position of second audio data at which second frequency analysis is started;

a noise band detector configured to detect a noise band for each of the plurality of analysis ranges based on the first result information and second result information;

a first filter processor configured to generate a first filter for filtering data of the noise band for each of the plurality of analysis ranges, apply a first filter process by the first filter on the first audio data for each of the plurality of analysis ranges, and thereby generate third audio data; and a first recorder configured to record the third audio data, wherein the first communicator transmits information on the second start position and the analysis range, to a second recording device, the first communicator further receives the second result information from the second recording device for each of the plurality of analysis ranges, the first communicator further transmits information on the noise band to the second recording device for each of the plurality of analysis ranges, and the second recording device generates the second audio data from second audio, performs the second frequency analysis on the second audio data for each of the plurality of analysis ranges, generates the second result information indicating a result of the second frequency analysis for each of the plurality of analysis ranges, generates a second filter for filtering data of the noise band for each of the plurality of analysis ranges, applies a second filter process by the second filter on the second audio data for each of the plurality of analysis ranges, and thereby generates fourth audio data for each of the plurality of analysis ranges.

2. The first recording device according to claim 1, further comprising:

a first audio quality determinator configured to determine a second audio quality of the second audio data based on the first audio quality, the second audio quality being different from the first audio quality, wherein the first communicator further transmits audio quality information about the second audio quality, to the second recording device.

3. The first recording device according to claim 1, further comprising:

a time difference calculator configured to detect a phase difference between the first audio and the second audio through a comparison process for comparing the first audio data and the second audio data, and calculate a difference between system times of the first recording device and the second recording device based on the detected phase difference, wherein the condition determinator determines the first start position and the second start position based on the difference between system times, and the first communicator further receives the second audio data from the second recording device.

4. A second recording device comprising:

a second audio input part configured to receive second audio, and generate second audio data from the received second audio;

a second communicator;

a second frequency analyzer configured to perform second frequency analysis on the second audio data for each of a plurality of analysis ranges, and generate second result information indicating a result of the second frequency analysis for each of the plurality of analysis ranges;

a second filter processor configured to generate a second filter for filtering data of a noise band for each of the plurality of analysis ranges, apply a second filter process by the second filter on the second audio data for each of the plurality of analysis ranges, and thereby generate fourth audio data for each of the plurality of analysis ranges; and a second recorder that records the fourth audio data, wherein the second communicator further receives information on the second start position and the analysis range from a first recording device, the second communicator further transmits the second result information to the first recording device for each of the plurality of analysis ranges, the second communicator further receives information on the noise band from the first recording device for each of the plurality of analysis ranges, the first recording device generates first audio data from first audio, performs first frequency analysis on the first audio data for each of the plurality of analysis ranges, generates first result information indicating a result of the first frequency analysis for each of the plurality of analysis ranges, determines a first start position and the second start position, determines the analysis range in accordance with a first audio quality of the first audio data, detects the noise band for each of the plurality of analysis ranges based on the first result information and the second result information, generates a first filter for filtering data of the noise band for each of the plurality of analysis ranges, applies a first filter process by the first filter on the first audio data for each of the plurality of analysis ranges, and thereby generates third audio data for each of the plurality of analysis ranges, and the first start position is a position of the first audio data at which the first frequency analysis is started, and the second start position is a position of the second audio data at which the second frequency analysis is started.

5. The second recording device according to claim 4, further comprising:

a second audio quality determinator configured to determine a second audio quality of the second audio data based on audio quality information, wherein the second communicator further receives the audio quality information from the first recording device.

6. A recording system comprising:

a first recording device; and a second recording device, wherein the first recording device includes a first audio input part configured to receive first audio, and generate first audio data from the received first audio;

a first communicator;

a first frequency analyzer configured to perform first frequency analysis on the first audio data for each of a plurality of analysis ranges, and generate first result information indicating a result of the first frequency analysis for each of the plurality of analysis ranges;

a condition determinator configured to determine a first start position and a second start position, determine the analysis range in accordance with a first audio quality of the first audio data, the first start position being a position of the first audio data at which the first frequency analysis is started, the second start position being a position of second audio data at which second frequency analysis is started;

a noise band detector configured to detect a noise band for each of the plurality of analysis ranges based on the first result information and second result information;

a first filter processor configured to generate a first filter for filtering data of the noise band for each of the plurality of analysis ranges, apply a first filter process by the first filter on the first audio data for each of the plurality of analysis ranges, and thereby generate third audio data by; and a first recorder configured to record the third audio data, wherein the first communicator transmits information on the second start position and the analysis range, to the second recording device, the first communicator further receives the second result information from the second recording device for each of the plurality of analysis ranges, and the first communicator further transmits information on the noise band to the second recording device for each of the plurality of analysis ranges, and the second recording device includes a second audio input part configured to receive second audio, and generate the second audio data from the received second audio;

a second communicator;

a second frequency analyzer configured to perform the second frequency analysis on the second audio data for each of a plurality of analysis ranges, and generate second result information indicating a result of the second frequency analysis for each of the plurality of analysis ranges;

a second filter processor configured to generate a second filter for filtering data of the noise band for each of the plurality of analysis ranges, apply a second filter process by the second filter on the second audio data for each of the plurality of analysis ranges, and thereby generate fourth audio data for each of the plurality of analysis ranges; and a second recorder configured to record the fourth audio data, wherein the second communicator receives information on the second start position and the analysis range from the first recording device, the second communicator further transmits the second result information to the first recording device for each of the plurality of analysis ranges, and the second communicator further receives information on the noise band from the first recording device for each of the plurality of analysis ranges.

7. A first recording method performed by a first recording device, comprising:

a first audio input step of receiving first audio, and generating first audio data from the received first audio;

a first frequency analysis step of performing first frequency analysis on the first audio data for each of a plurality of analysis ranges, and generating first result information indicating a result of the first frequency analysis for each of the plurality of analysis ranges;

a condition determination step of determining a first start position and a second start position, determining the analysis range in accordance with a first audio quality of the first audio data, the first start position being a position of the first audio data at which the first frequency analysis is started, and the second start position being a position of second audio data at which second frequency analysis is started;

a noise band detection step of detecting a noise band for each of the plurality of analysis ranges based on the first result information and second result information;

a first filter processing step of generating a first filter for filtering data of the noise band for each of the plurality of analysis ranges, applying a first filter process by the first filter on the first audio data for each of the plurality of analysis ranges, and thereby generating third audio data;

a first recording step of recording the third audio data;

a first transmission step of transmitting information on the second start position and the analysis range, to a second recording device;

a reception step of receiving the second result information from the second recording device for each of the plurality of analysis ranges; and a second transmission step of transmitting information on the noise band to the second recording device for each of the plurality of analysis ranges, wherein the second recording device generates the second audio data from second audio, performs the second frequency analysis on the second audio data for each of the plurality of analysis ranges, generates the second result information indicating a result of the second frequency analysis for each of the plurality of analysis ranges, generates a second filter for filtering data of the noise band for each of the plurality of analysis ranges, applies a second filter process by the second filter on the second audio data for each of the plurality of analysis ranges, and thereby generates fourth audio data for each of the plurality of analysis ranges.

8. A second recording method performed by a second recording device, comprising:

a second audio input step of receiving second audio, and generating second audio data from the received second audio;

a second frequency analysis step of performing second frequency analysis on the second audio data for each of a plurality of analysis ranges, and generating second result information indicating a result of the second frequency analysis for each of the plurality of analysis ranges;

a second filter processing step of generating a second filter for filtering data of the noise band for each of the plurality of analysis ranges, applies a second filter process by the second filter on the second audio data for each of the plurality of analysis ranges, and thereby generates fourth audio data;

a second recording step of recording the fourth audio data;

a first reception step of receiving information on the second start position and the analysis range from the first recording device;

a transmission step of transmitting the second result information to the first recording device for each of the plurality of analysis ranges; and a second reception step of receiving information on the noise band from the first recording device for each of the plurality of analysis ranges, wherein the first recording device generates first audio data from first audio, performs first frequency analysis on the first audio data for each of the plurality of analysis ranges, generates first result information indicating a result of the first frequency analysis for each of the plurality of analysis ranges, determines a first start position and the second start position, determines the analysis range in accordance with a first audio quality of the first audio data, detects the noise band for each of the plurality of analysis ranges based on the first result information and the second result information, generates a first filter for filtering data of the noise band for each of the plurality of analysis ranges, applies a first filter process by the first filter on the first audio data for each of the plurality of analysis ranges, and thereby generates third audio data for each of the plurality of analysis ranges, and the first start position is a position of the first audio data at which the first frequency analysis is started, and the second start position is a position of the second audio data at which the second frequency analysis is started.

9. A non-transitory computer-readable storage medium storing a computer program, which when loaded and run in a computer processor of a first recording device causes the processor to execute:

a first audio input step of receiving first audio, and generating first audio data from the received first audio;

a first frequency analysis step of performing first frequency analysis on the first audio data for each of a plurality of analysis ranges, and generating first result information indicating a result of the first frequency analysis for each of the plurality of analysis ranges;

a condition determination step of determining a first start position and a second start position, determining the analysis range in accordance with a first audio quality of the first audio data, the first start position being a position of the first audio data at which the first frequency analysis is started, and the second start position being a position of second audio data at which second frequency analysis is started;

a noise band detection step of detecting a noise band for each of the plurality of analysis ranges based on the first result information and second result information;

a first filter processing step of generating a first filter for filtering data of the noise band for each of the plurality of analysis ranges, applying a first filter process by the first filter on the first audio data for each of the plurality of analysis ranges, and thereby generating third audio data;

a first recording step of recording the third audio data;

a first transmission step of transmitting information on the second start position and the analysis range, to a second recording device;

a reception step of receiving the second result information from the second recording device for each of the plurality of analysis ranges; and a second transmission step of transmitting information on the noise band to the second recording device for each of the plurality of analysis ranges, wherein the second recording device generates the second audio data from second audio, performs the second frequency analysis on the second audio data for each of the plurality of analysis ranges, generates the second result information indicating a result of the second frequency analysis for each of the plurality of analysis ranges, generates a second filter for filtering data of the noise band for each of the plurality of analysis ranges, applies a second filter process by the second filter on the second audio data for each of the plurality of analysis ranges, and thereby generates fourth audio data for each of the plurality of analysis ranges.

10. A non-transitory computer-readable storage medium storing a computer program, which when loaded and run in a computer processor of a second recording device causes the processor to execute:

a second audio input step of receiving second audio, and generating second audio data from the received second audio;

a second frequency analysis step of performing second frequency analysis on the second audio data for each of a plurality of analysis ranges, and generating second result information indicating a result of the second frequency analysis for each of the plurality of analysis ranges;

a second filter processing step of generating a second filter for filtering data of the noise band for each of the plurality of analysis ranges, applies a second filter process by the second filter on the second audio data for each of the plurality of analysis ranges, and thereby generates fourth audio data;

a second recording step of recording the fourth audio data;

a first reception step of receiving information on the second start position and the analysis range from the first recording device;

a transmission step of transmitting the second result information to the first recording device for each of the plurality of analysis ranges; and a second reception step of receiving information on the noise band from the first recording device for each of the plurality of analysis ranges, wherein the first recording device generates first audio data from first audio, performs first frequency analysis on the first audio data for each of the plurality of analysis ranges, generates first result information indicating a result of the first frequency analysis for each of the plurality of analysis ranges, determines a first start position and the second start position, determines the analysis range in accordance with a first audio quality of the first audio data, detects the noise band for each of the plurality of analysis ranges based on the first result information and the second result information, generates a first filter for filtering data of the noise band for each of the plurality of analysis ranges, applies a first filter process by the first filter on the first audio data for each of the plurality of analysis ranges, and thereby generates third audio data for each of the plurality of analysis ranges, and the first start position is a position of the first audio data at which the first frequency analysis is started, and the second start position is a position of the second audio data at which the second frequency analysis is started.

* * * * *